US007627961B2

(12) United States Patent
Brewer et al.

(10) Patent No.: US 7,627,961 B2
(45) Date of Patent: Dec. 8, 2009

(54) ENHANCED SOLE ASSEMBLY WITH OFFSET HOLE

(75) Inventors: Chris Brewer, Baltimore, MD (US); Olivier Henrichot, New York, NY (US)

(73) Assignee: Fila Luxembourg S.A.R.L., Luxembourg (LU)

( * ) Notice: Subject to any disclaimer, the term of this patent is extended or adjusted under 35 U.S.C. 154(b) by 244 days.

(21) Appl. No.: 11/289,522

(22) Filed: Nov. 30, 2005

(65) Prior Publication Data

US 2007/0119073 A1 May 31, 2007

(51) Int. Cl.
*A43B 7/06* (2006.01)
*A43B 13/18* (2006.01)

(52) U.S. Cl. ..... 36/3 B; 36/28

(58) Field of Classification Search ..... 36/3 B, 36/28, 27, 29

See application file for complete search history.

(56) References Cited

U.S. PATENT DOCUMENTS

| | | | | |
|---|---|---|---|---|
| 3,354,562 | A | 11/1967 | Munari | |
| D267,288 | S | 12/1982 | Davis | |
| D267,366 | S | 12/1982 | Davis | |
| 4,459,765 | A | 7/1984 | Power | |
| 4,494,320 | A | 1/1985 | Davis | |
| 4,571,852 | A | 2/1986 | Lamarche et al. | |
| 4,821,430 | A | 4/1989 | Flemming et al. | |
| 4,928,404 | A * | 5/1990 | Scheuermann | 36/37 |
| 4,939,851 | A * | 7/1990 | Miller | 36/3 B |
| 5,203,097 | A | 4/1993 | Blair | |
| 5,461,800 | A * | 10/1995 | Luthi et al. | 36/28 |
| 5,604,998 | A | 2/1997 | Kita | |
| D400,344 | S | 11/1998 | Avar | |
| 6,305,100 | B1 * | 10/2001 | Komarnycky et al. | 36/3 R |
| 6,338,206 | B1 * | 1/2002 | Kita | 36/29 |
| 6,393,732 | B1 * | 5/2002 | Kita | 36/30 R |
| 6,446,359 | B2 | 9/2002 | Tomat | |
| D470,296 | S | 2/2003 | Masullo | |
| 6,711,834 | B1 * | 3/2004 | Kita | 36/27 |
| 2002/0050075 | A1 * | 5/2002 | Moretti | 36/3 R |
| 2003/0019129 | A1 | 1/2003 | Kobayashi et al. | |
| 2004/0016144 | A1 | 1/2004 | Gallegos | |
| 2004/0020080 | A1 | 2/2004 | Cox et al. | |
| 2006/0201028 | A1 * | 9/2006 | Chan et al. | 36/28 |

FOREIGN PATENT DOCUMENTS

| | | |
|---|---|---|
| EP | 0383489 | 8/1990 |
| GB | 2262024 | 6/1993 |
| WO | WO 91/16830 | 11/1991 |

* cited by examiner

*Primary Examiner*—Ted Kavanaugh
(74) *Attorney, Agent, or Firm*—Oblon, Spivak, McClelland, Maier & Neustadt, L.L.P.

(57) ABSTRACT

A sole assembly including a midsole made of resilient cushion material and having an upper support surface configured to support a plantar region of a human foot, a lower surface and a sidewall connecting the upper and lower surfaces. An outsole is provided on the lower surface and configured to provide traction with a ground surface. Further, at least one sidewall hole provided in the sidewall and configured to provide ventilation to the foot, wherein the at least one sidewall hole is provided at a predetermined position in the sidewall in order to accommodate a characteristic of the foot.

13 Claims, 22 Drawing Sheets

ENHANCED SOLE ASSEMBLY WITH OFFSET HOLE

FIELD OF THE INVENTION

The present invention relates to a device that supports a person's foot, and more specifically, to a sole assembly including an offset through hole in heel portion of the midsole.

BACKGROUND OF THE INVENTION

Contemporary shoes provide a complex combination of cushion, traction, and body-fitting elements that facilitate the natural progression of the foot along the ground during wear. When walking or running, the first part of the foot to strike the ground is the heel at the instant of "heelstrike." Then the foot rolls forward from the heel region, through the midfoot region and the ball of the foot, and finally to the toe region where the foot breaks contact with the ground in a "toe-off" action. In addition to the above-described progression from the heel to the toe, the foot typically rolls from the outside to the inside (lateral side to the medial side), a process called "pronation" which disperses some of the energy generated during the impact of the foot with the ground. In some cases, the foot may not pronate enough, a condition called "underpronation" or "supination." Furthermore, persons with underdeveloped arches may suffer from "overpronation," wherein the foot rolls inward excessively. Either condition is unhealthy for the foot and can cause shin or joint pain.

A shoe generally includes a "sole assembly" that provides the main weight bearing support at the plantar region of the foot, and an "upper" that connects to the sole assembly and surrounds other areas of the foot. The sole assembly typically includes an outsole and a midsole. The outsole is generally the portion of the sole assembly that makes contact with the ground, while the midsole is positioned just above (as the shoe normally touches the ground) the outsole and usually provides a cushioning affect. An insole, typically separate from the sole assembly, is normally positioned above the midsole and within the upper of the shoe to make contact with the wearer's foot. As the main support for the wearer's weight, the sole assembly of a shoe plays an important role in providing a healthful, natural stride.

Early sole assemblies included a continuous midsole formed of a single piece of foam cushion material that formed a continuous bottom surface on which a tread outsole was provided. This design was initially adopted by the footwear industry because of its simple structure, which made manufacturing easy and cost effective. However, conventional continuous midsole designs required thick slabs of foam material in order to effectively absorb and disperse impact and propulsion forces generated during athletic use. Further, these conventional unitary sole designs were heavy and held the foot relatively high above the ground surface, thereby reducing lateral stability. Based on these characteristics, the footwear industries has perceived the unitary sole to be unsuitable for athletic footwear and has developed alternative designs for performance footwear.

For example, a split sole assembly design has evolved as an industry standard for lightweight athletic shoes. With split soles, the heel and toe sections of the midsole are separated by a pronounced arch or deep groove, and a lightweight rigid shank is typically used to structurally connect the heel and toe regions of the midsole. As the shank allows removal of a substantial portion of the midsole foam, the split sole design generally provides a lightweight sole assembly. However, the present inventors have recognized that the shank region of the split sole is typically raised from ground contact (particularly along a periphery), which reduces traction capabilities and lateral support in this region of the split sole design. Further, the arched shank region requires a vertical dimension that increases the overall height of the split sole assembly, thus further reducing lateral stability. Yet another problem with the split sole is that the discrete heel region of this design generally concentrates heel strike forces in a small area making it more difficult for the wearer to naturally transition heel impact forces to midstance and toe off during stride.

Various known footwear devices have also been developed to enhance performance of athletic shoes. For example, U.S. Pat. No. 4,821,430 to Flemming et al. describes a heel counter having a U-shaped side wall extending about a heel portion of a shoe upper, and a flexible membrane connected to a bottom portion of the U-shaped wall. Under the wearer's weight, the membrane flexes to draw the U-shaped wall inward to laterally support the wearer's foot. However, while not specified in the '430 patent, such support features have been implemented only in non-unitary sole designs such as the split sole described above. Moreover, the heel counter does nothing to reduce the overall height of the sole assembly, and the thin membrane provides only weak support for wearer's heel and little dispersion of heel impact forces. Still further, the flexible membrane may be a barrier to ventilation of the foot.

Footwear features have also been developed to provide improved ventilation to the wearer's foot. For example, air passages that extend from a bottom surface of the sole assembly to an interior of the shoe upper have been used to increase air flow to the wearer's foot. As these through holes remove outsole and midsole material they also reduce the weight of the sole assembly. Again, however, these ventilation features have been implemented in non-unitary sole designs. Moreover, passages that extend from the bottom of the outsole can function as suction cups on the outsole, thus causing additional resistance to lifting the foot, especially in wet or muddy areas. While side surface air passages are also known, these passages typically extend only from a lateral to medial side of the sole assembly, thus providing no ventilation to the interior of the shoe. Further, placement of side passages is typically based only on weight considerations or aesthetics, making other footwear design considerations necessary to address unique characteristics of a wearer such as under pronation or over pronation.

SUMMARY OF THE INVENTION

Accordingly, one object of the present invention is to address at least some of the above described and/or other problems of conventional footwear sole assemblies.

Another object of the present invention is to provide a unitary sole assembly that mitigates the problems of a split sole assembly, but includes enhancements for mitigating conventional problems with unitary midsoles.

Yet another object of the present invention is to provide a unitary sole assembly having a heel cradle for facilitating a natural transition of impact and propulsion forces during the wearer's stride.

Still another object of the present invention is to provide a unitary sole assembly having air passages that facilitate air flow to an interior of the shoe.

Yet another object of the present invention is to provide a sole assembly air passage that facilitates air flow to an interior of the shoe and is also placed in a predetermined location to accommodate a characteristic of the wearer.

These and/or other objectives of the present invention can be provided by a sole assembly according to an embodiment of the invention. In one aspect, the sole assembly includes a midsole made of resilient foam material and having an upper support surface configured to support a plantar region of a human foot, a lower surface a sidewall connecting the upper and lower surfaces. An outsole is provided on the lower surface and configured to provide traction with a ground surface. Further, at least one sidewall hole provided in the sidewall and configured to provide ventilation to the foot, wherein the at least one sidewall hole is provided at a predetermined position in the sidewall in order to accommodate a characteristic of the foot.

Another aspect of the invention includes a sole assembly having a midsole made of resilient foam material and having an upper support surface configured to support a plantar region of a human foot, a lower surface a sidewall connecting the upper and lower surfaces. An outsole provided on the lower surface and configured to provide traction with a ground surface. Further, means are provided for providing ventilation to the foot and biasing the foot in a lateral or medial direction to accommodate a characteristic of the foot.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

As discussed in the Background section above, while split sole designs can provide reduced weight, these designs also reduce traction and lateral stability, and impede the natural transition from heel to toe off during the wearer's stride. In view of these problems, the present inventors have recognized that a unitary midsole design can reduce or eliminate the problems of the split sole structure. Specifically, a unitary midsole design provides more ground surface contact area than a split sole, particularly along the periphery of the sole assembly. This ground contact area can provide improved traction and lateral support in the midfoot region during athletic activities. Thus, the present inventors have developed athletic shoes having an enhanced unitary midsole that mitigates the problems with split sole structures, while also reducing conventional unitary sole problems that have led the footwear industry to develop alternative sole assembly designs for athletic shoes.

Figure 1:
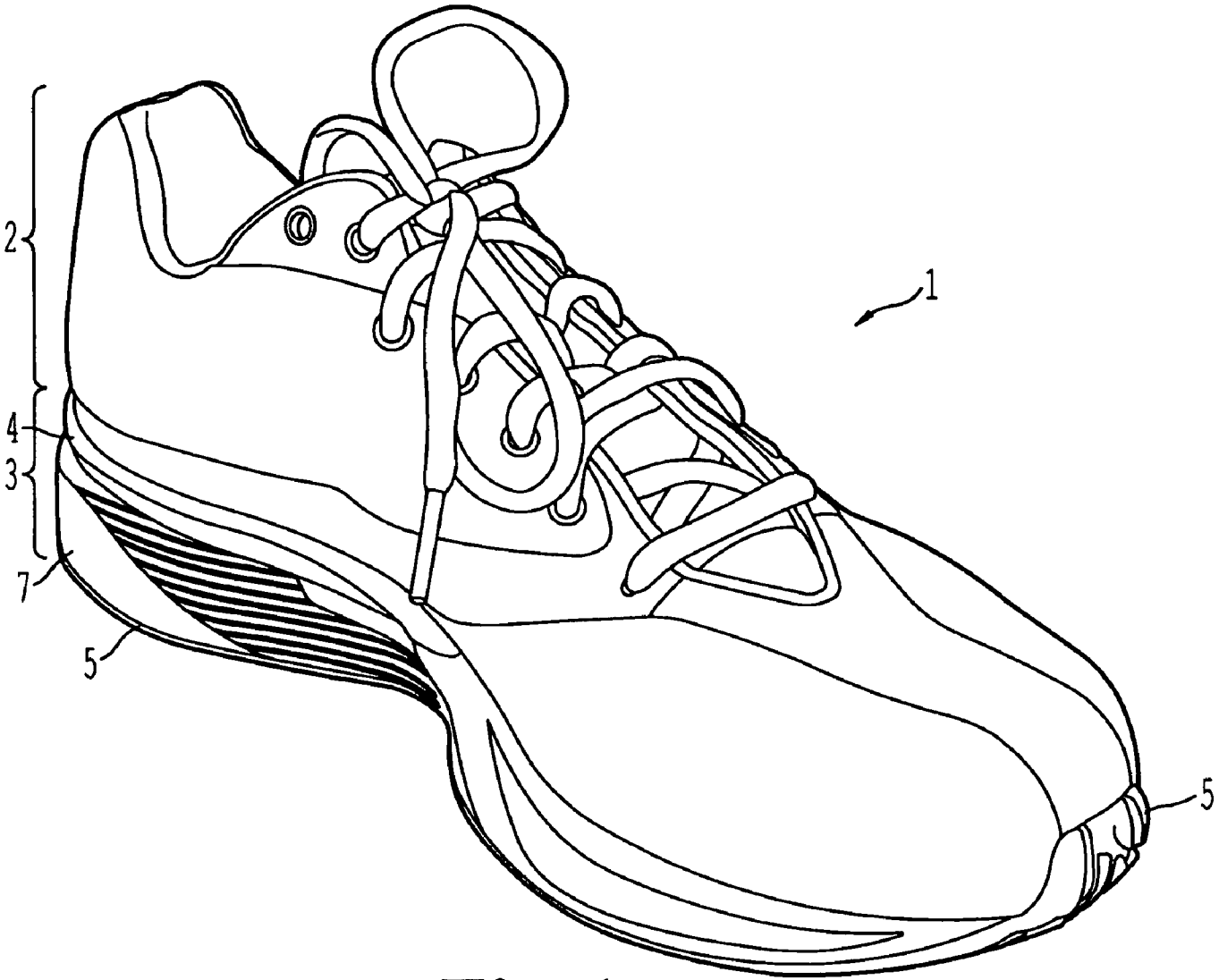
FIG. 1 is a perspective view of a left-foot shoe incorporating a sole assembly according to a first non-limiting embodiment of the present invention.
Figure 2:
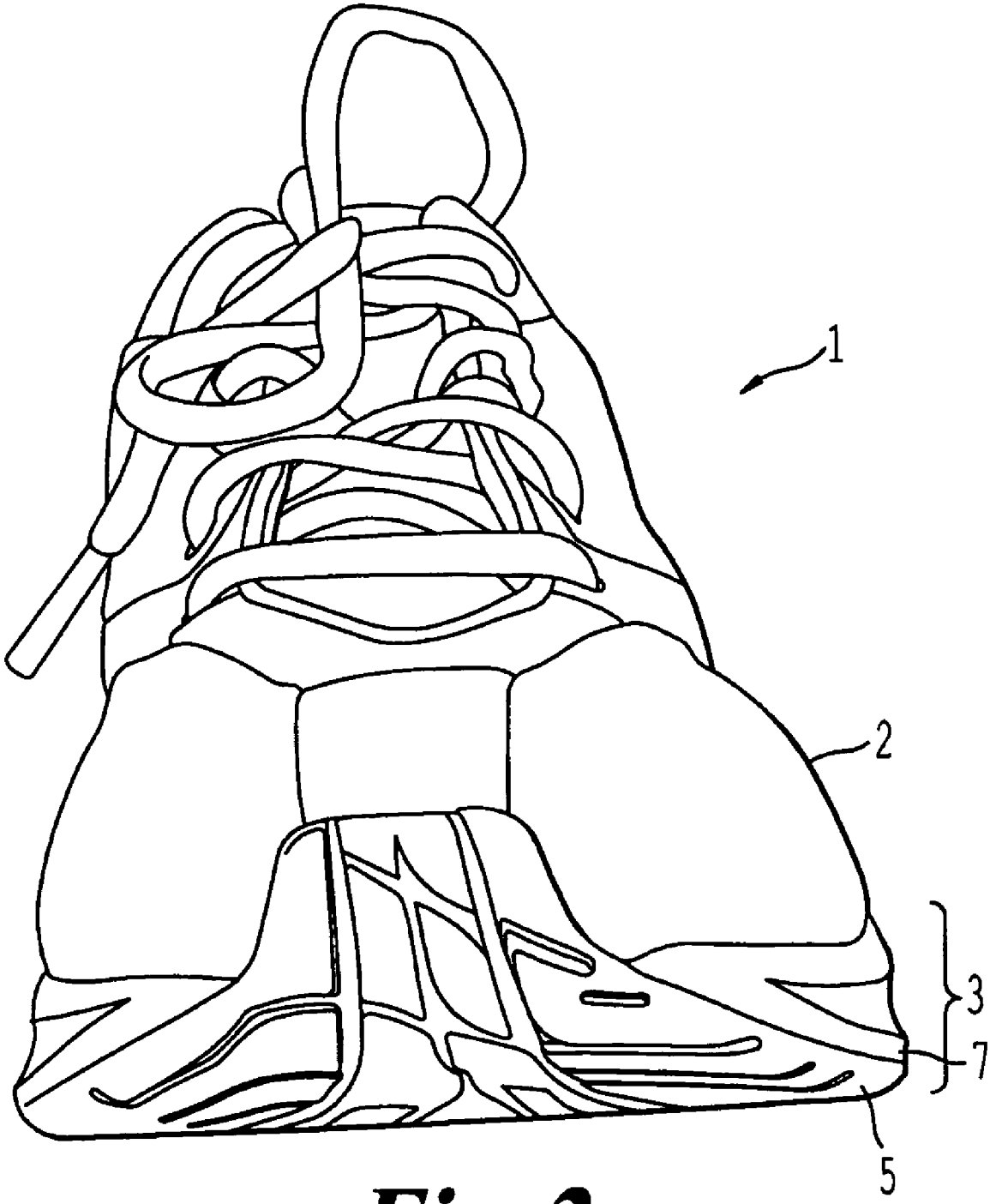
FIG. 2 is a front view of a shoe incorporating a sole assembly according to the first exemplary embodiment of the present invention.

Referring now to the drawings, wherein like reference numerals designate identical or corresponding parts throughout the several views, FIG. 1 is a perspective view of a shoe 1 incorporating a sole assembly 3 according to the first non-limiting embodiment of the present invention. As seen in FIG. 1, the shoe includes an upper 2 attached to the sole assembly 3. The upper 2 is preferably made of durable sheets of non-elastic material such as leather, canvas, synthetic material or any other upper material known to those skilled in the art of shoes. In a preferred embodiment, the upper is a breathable nylon mesh material reinforced with outer layer regions of nylon netting. The upper 2 may be attached to the sole assembly 3 by stitching, adhesion or any other method known in the art.

In the non-limiting embodiment of FIG. 1, the sole assembly 3 includes a heel cradle 4, an outsole 5, and a unitary midsole 7. The term "unitary midsole" is meant to indicate a midsole that is substantially continuous from the heel region to the toe region in that it has no major split or rift between the these regions. However, the unitary midsole may include features such as seams, framework, or holes as long as the unitary midsole 7 forms a substantially continuous lower surface upon which the outsole 5 can be supported. In some cases, the substantially continuous surface will be formed of a combination of foam cushion material and rigid or semi-rigid structure.

As shown in FIGS. 1, 2, 4 and 5 the outsole 5 extends from the heel area of the sole assembly 3 to the toe area. The portion of the outsole 5 at the very end of the toe is tapered such that the outsole 5 does not interfere with turning or pivoting of the foot. In other embodiments, the outsole 5 may wrap upward and around the toe of the shoe to a lesser extent than shown in the figures. In fact, such a wrapping arrangement is not necessary, but is merely one way of enhancing the flow of the foot from heel-strike to toe-off. Furthermore, the outsole 5 may taper differently or even not taper at all, depending on the application for which the shoe is designed.

Figure 3:
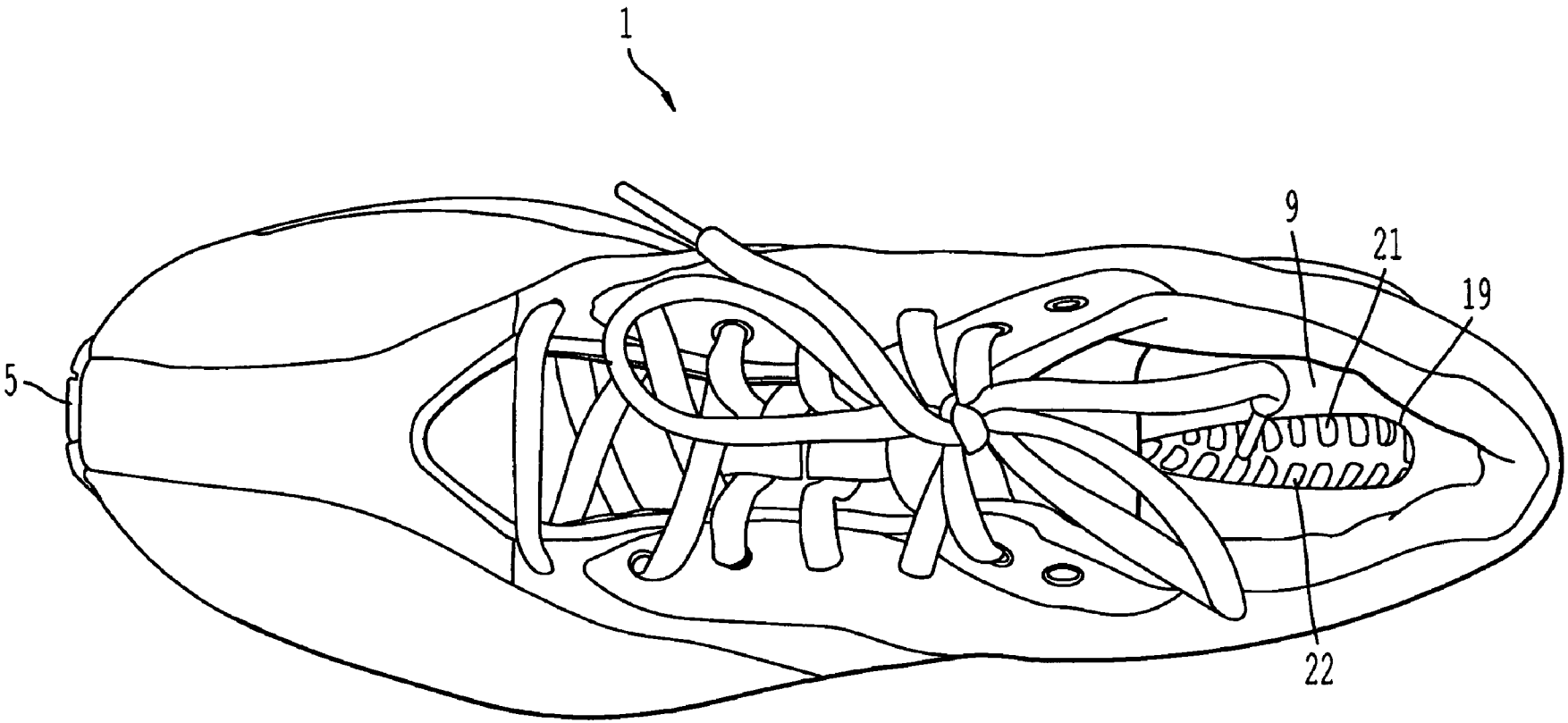
FIG. 3 is a top view of a shoe incorporating a sole assembly according to the first exemplary embodiment of the present invention.

FIG. 3 shows a typical shoe "upper" configured to attach to the sole assembly 3. In the heel region of upper shown in FIG. 3, the location of pellet-sized holes 22 and fine mesh 21 are shown. Although the pellet-sized holes 22 and fine mesh 21 are not normally visible in this view because they are covered by insole 9, they are schematically represented in FIG. 3 to clarify later detailed discussion of the heel cradle 4.

Figure 4:
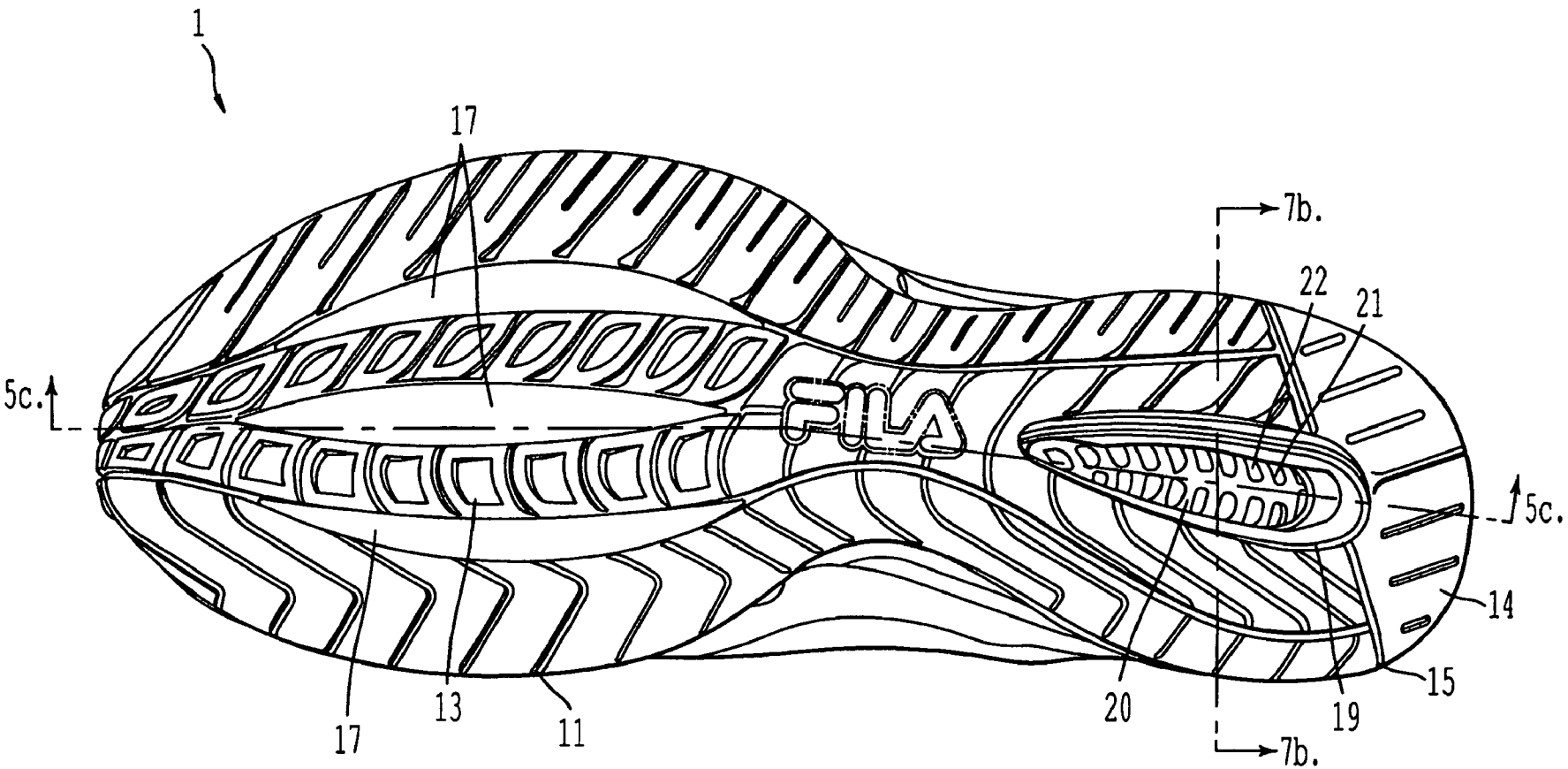
FIG. 4 is a bottom view of a shoe and various section lines incorporating a sole assembly according to the first exemplary embodiment of the present invention.

FIG. 4 shows one exemplary embodiment of the bottom of the sole assembly 3 with emphasis on the outsole 5. The outsole 5 is substantially continuous from the heel portion of the sole assembly 3 to the toe portion. In particular, the outsole 5 has a substantially continuous peripheral edge that allows the full periphery of the outsole to contact the ground during sporting activities. As seen in FIG. 4, the outsole 5 is not a perfectly smooth or planar surface, but rather is a surface with grooves and indentations which supply traction. The outsole 5 includes a tread portion which can be made of various tough, flexible materials such as, for example, carbon rubber, and is designed to provide gripping of various surfaces.

In the embodiment shown in FIG. 4, the tread portion includes a tread 11 on its outer portion and a tread 13 located within the outer tread 11. The tread 13 is separated from the tread 11 by longitudinal gaps 17 which are low profile areas of relatively flexible material that facilitate width expansion of the forefoot of the sole assembly during activities. It should be noted that the tread types are not limited to the tread 11 and tread 13 shown in FIG. 3. Furthermore, the outsole 5 may have more types of tread, only one type of tread, or even a substantially smooth surface. Additionally, the gaps 17 are optional. For example, the tread 11 and the tread 13 may be placed next to each other. In outsoles with only a single type of tread, the gaps 17 may still be included to form channels around the tread.

As further shown in FIG. 4, the rear tread 14 is separated from the tread in the front of the shoe by heel groove 15. The heel groove 15 is relatively shallow. In other words, unlike outsoles used in combination with split midsoles, the outsole 5 is able to remain substantially continuous (when one appreciates that the width of the groove 15 is such that the groove does not allow the heel portion and toe portions of the outsole 5 to move or undergo stress without substantially affecting each other). The groove 15 demarks an inflection point in the curvature of the outsole 5. In front of the groove 15, the outsole 5 is generally parallel with the surface of the ground when the shoe 1 is resting on the ground. Behind the groove 15, the tread 14 is angled upward such that a space is formed between the outsole 5 and the ground when the shoe is at rest on the ground. This space enhances the flow of the foot from heel-strike to toe-off during walking.

Also shown in FIG. 4 is the outsole hole 19 and screen 20. The outsole hole 19 penetrates through the outsole 5, midsole 7, and heel cradle 4 (if present), exposing the insole 9 and the heel of the foot to airflow. The screen 20 protects the insole 9 from objects on the ground and provides support to the heel of the foot while providing good ventilation to the foot, as will be further described below. In FIG. 4, the screen 20 is depicted as having a series of pellet-sized holes 22. However, the screen 20 can include a fine mesh 21 made of wire or plastic with barely visible holes. A combination of screens may be used. For example, the screen 20 may include one coarse screen and one fine screen or a fine screen that further includes some larger holes.

In one alternative embodiment, the coarse screen is provided by making multiple pellet-sized holes 22 in the bottom of the heel cradle 4 itself. In other embodiments, the screen 20 merely covers a single large hole in the heel cradle 4. In both cases, the bottom of the heel cradle 4 is made more flexible in the center, thus enhancing the heel centering effect of the heel cradle while also providing ventilation. Accordingly, the hole in the base of the heel cradle 4 not only provides a port for air to reach the bottom of the wearer's heel, but assists in centering the heel of the foot onto the sole assembly.

It should be noted that the outsole hole 19 is shown in the embodiment of FIG. 4 as having a teardrop shape. However, other shapes such as ovals, circles and angular shapes are possible. In alternate embodiments, the outsole hole 19 may be formed of two or more holes. For example, the outsole hole 19 may be formed of two holes located next to each other and separated by a wall of material from the unitary midsole 7 and/or outsole 5.

Figure 5A:
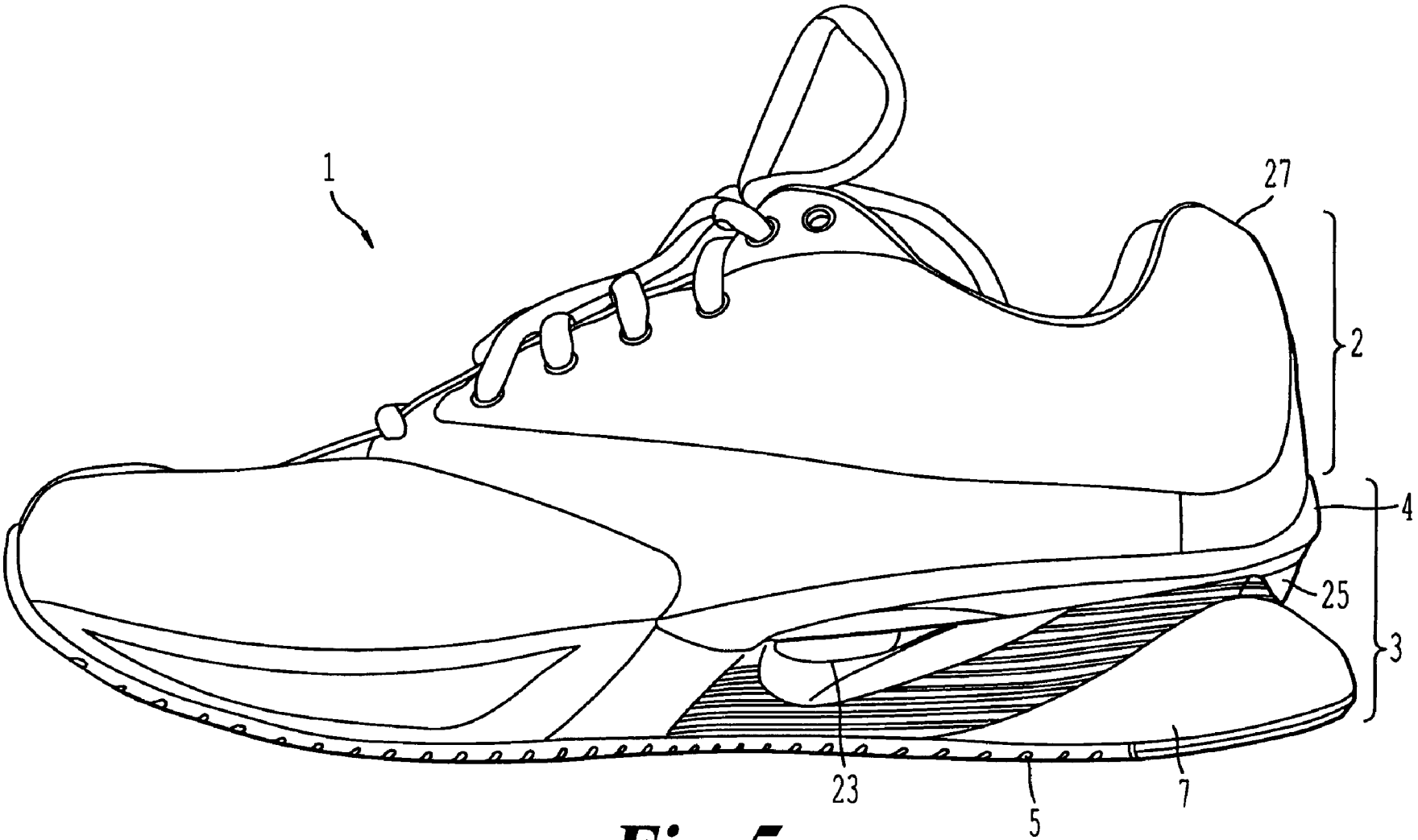
FIG. 5*a* shows the lateral side of a sole assembly according to the first exemplary embodiment of the present invention.

In FIG. 5*a*, the lateral side of one embodiment of the shoe 1 is shown. In this embodiment, the sole assembly 3 includes lateral side hole 23 and heel hole 25 formed integrally with the unitary midsole 7. The lateral side hole 23 of FIG. 5*a* is formed directly into the unitary midsole 7 such that no further structure is incorporated into the unitary midsole 7. The lateral side hole 23 proceeds inward toward the center of the unitary midsole 7 such that it is in fluid communication with the bottom hole 19 and the heel hole 25. Thus, the lateral side hole 23 and heel hole 25 can function as an exhaust to enhance refreshed air flow to the bottom of the foot and reduce problems associated with the suction cup effect.

The present inventors have also recognized that placement of the holes affects how the sole assembly responds to the pressures generated during walking. Thus, in addition to providing airflow to the foot, the holes may be used to enhance the transition of the foot from heel to toe as the wearer walks. Further, strategic placement of holes or structural alteration of through holes may be used to provide functionality that accommodates a particular characteristic of the wearer, such as over-pronation or under-pronation. Provisional Application Ser. No. 60/709,792 discloses various methods of measuring a characteristic of the wearer in order to determine a footwear designs such as ventilation hole placement, suitable for the wearer. This provisional application is hereby incorporated herein in its entirety. It is noted that the midsole hole placement feature described herein may be used with any sole assembly and is not limited to the unitary midsole assembly.

In the embodiment of FIGS. 1-7, the lateral hole 23 is placed so as to preferentially cushion the lateral side of the unitary midsole 7 to prevent over-pronation of the foot during striding. In other words, instead of (or in addition to) augmenting the medial side of the shoe to prevent collapse of the arch, the lateral side of the unitary midsole 7 incorporates lateral hole 23 to soften this side of the unitary midsole 7. By changing the size, location, and shape of the lateral hole 23, the unitary midsole 7 can be tuned to provide different levels of compliance on the lateral side. Thus, no augmentation and associated addition of material on the medial side of the sole assembly is necessary. The heel hole 25 can also be positioned to accommodate a particular characteristic of the wearer, as will be discussed below. It is noted that the midsole hole placement feature As also seen in FIG. 5*a*, the heel cradle 4 extends from the heel of the shoe toward the forefoot of the shoe and forms an upper surface of the lateral side hole 23 and heel hole 25, thus providing a bridge across these holes. The addition of the heel cradle 4 can enhance the effect of the lateral hole 23 (or other strategically placed holes in the unitary midsole 7) by improving a position of the wearer's heel as the heel of the foot lifts and descends during walking or running. The present inventors have realized that by consistently centering the heel of the foot in relation to the sole assembly, the support function of the midsole is improved. That is, proper positioning of the heel allows the sole assembly 3 to smoothly accommodate the natural gait of the wearer and to provide support where needed.

In addition to foot positioning, the heel cradle 4 can enhance the absorption and dispersion characteristics of the unitary sole. Thus, the heel cradle is preferably a rigid or semi-rigid structure that can support the bottom of the heel and disperse impact and propulsion forces across a large area of the unitary midsole 7 during stride. This allows the unitary midsole 7 to be thinner than conventional midsoles, which reduces the weight and overall height of the sole assembly. For example, the typical height of an athletic shoe sole assembly is approximately 12 mm or 13 mm in the forefoot region and 24 mm or 25 mm in the heel region, while a sole assembly having a unitary midsole according to the present invention can be between 16 and 24 mm in the heel region and/or 6-12 mm in the forefoot region. In a preferred embodiment, the sole assembly is approximately 18 mm in the heel region and 9 mm in the forefoot region, or more preferably approximately 16 mm in the heel region and 6 mm in the forefoot. This reduced height brings the wearer's heel closer to the ground surface thereby providing improved lateral stability. Still further the heel cradle 4 can enhance durability of the cushion by dispersing the force of the heel-strike so as to prevent any particular part of the cushion from suffering compaction due to repeated, concentrated impact.

In the embodiment of FIG. 5*a*, the heel cradle 4 is external to an upper heel support 27 which is typically made of flexible material such as leather, sheeted plastic, or canvas etc. However, the heel cradle 4 may be formed inside the upper heel support 27 so as to be invisible to the wearer.

The heel cradle 4 also curves upward on the medial and lateral sides of the foot so as to center the foot within the sole assembly 3. The heel hole 25 can further enhance the centering effect of the heel cradle by providing a compliant area directly under the heel bone. In the embodiment of FIG. 5*a*, the heel cradle has a much greater height in the back of the heel than it does on the sides. However, typically the height of the heel cradle 4 is not made so large that the heel cradle 4 impacts the Achilles tendon during striding.

In alternative embodiments, the heel cradle 4 and the heel support 27 are integrally formed together. In this case, the heel cradle 4 and heel support 27 are differentiated by marked differences is stiffness. This arrangement allows a simpler manufacturing setup and can provide enhanced durability. On the other hand, in embodiments where the heel cradle 4 and heel support 27 are formed separately, the stiffness of the heel cradle 4 can be more specifically tuned to the needs of the wearer than if the heel cradle 4 and heel support 27 are made integrally.

Figure 5B:
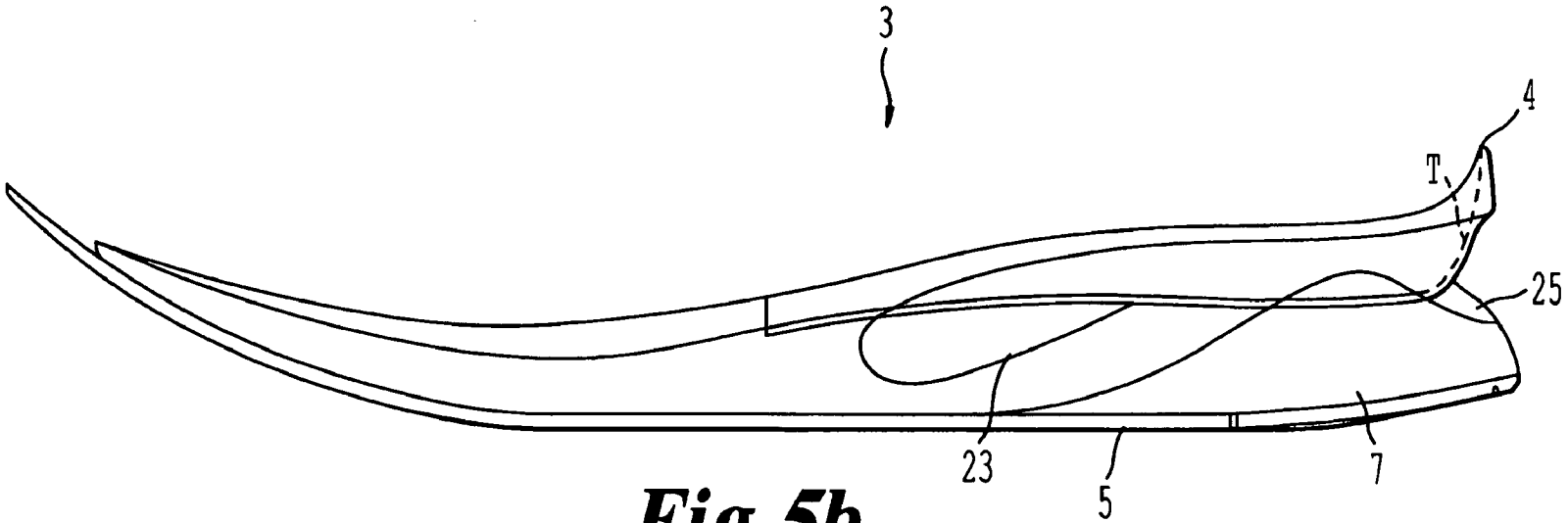
FIG. 5*b* shows a lateral side of a sole assembly according to the first exemplary embodiment of the present invention.

FIG. 5*b* shows the sole assembly 3 of FIG. 5*a* in isolation. As shown in FIG. 5*b*, the heel cradle is slightly concave downward. This shape conforms to the arch of the foot and provides a naturally supportive arch structure. The thickness of the material of the heel cradle 4 is shown with a dashed line T. In general, the thickness of the heel cradle will be from 1 mm to 10 mm, more preferably 0.5-5 mm. Of course, the heel cradle may be shaped differently for functional or aesthetic purposes. The heel cradle is typically made of plastic or a carbon fiber material, but other materials may be used.

Figure 5C:
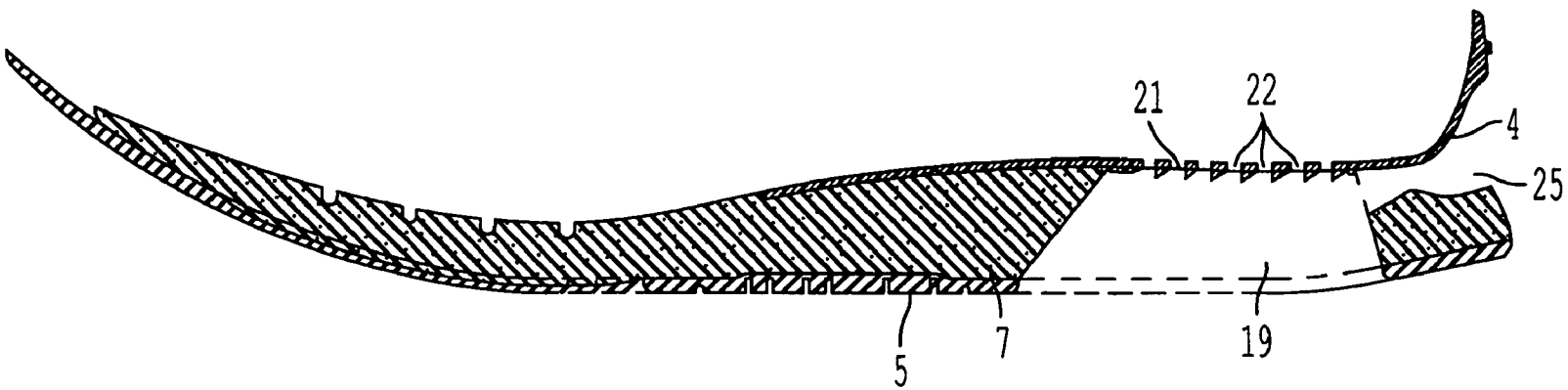
FIG. 5*c* shows a cross-section along line 5*c* of the sole assembly shown in FIGS. 4 and 5*a;*

FIG. 5*c* is a cross-section view of the lateral side of the unitary midsole 7 taken along section line 5*c* shown in FIG. 4*a*. As is clearly shown in FIG. 5*c*, the heel cradle 4 extends from the heel of the shoe to approximately the midfoot area. One beneficial effect of having a large heel cradle between the foot and the unitary midsole 7 is that the heel cradle 4 can be enhanced as a force dispersing plate to further reduce concentration the force generated during heel-strike into the same area of the cushion. In other words, the heel cradle 4 spreads the impact energy generated in each footstep so that the unitary midsole 7 does not compact small areas of the midsole 7. This spreading or dispersion effect helps maintain the cushioning properties of the unitary midsole 7 and can lead to a thinner sole assembly as noted above. Without such a dispersion effect, the unitary midsole 7 may plastically deform such that it becomes molded into the shape of the bottom of the foot. As the heel cradle 4 is typically made from relatively stiff material, the heel cradle 4 still functions to disperse the impact energy generated during striding, even though the heel cradle can be as thin as approximately 1 mm.

FIG. 5*c* further shows pellet-sized holes 22 and fine mesh 21 of the screen 20 in cross-section. In this embodiment, the pellet sized holes are formed in the heel cradle 4 itself. It is also possible that the pellet-sized holes 22 or the screen 20 are formed in separate components inserted into the sole assembly 3. Forming the pellet-sized holes 22 in a separate component allows the heel cradle 4 and the separate component to be made of different materials, and, therefore, the amount of support provided to the heel of the foot can be tuned more precisely to optimize the centering effect of the heel cradle 4.

As discussed above, the lateral side hole 23 is in fluid communication with the bottom hole 19 and the heel hole 25. Thus, air may flow into any of the holes and out through any of the others, and no problems with a "suction-cup" effect occur. Additionally, the screen 20 allows air to be "pumped" directly to the heel of the foot. As the lateral side hole 23 and bottom hole 19 typically face the direction of motion of the shoe 1 (sideways and downward), air typically flows into these holes and out the heel hole 25, fine mesh 21, and pellet sized holes 22. The lateral and bottom holes may be streamlined to enhance this effect.

As the cross-section along line 5*c* is taken near the center of the shoe, the connection point between the lateral side hole 23 and the bottom hole 19 is not shown in FIG. 5*c*, but it should be understood that the lateral side hole 23 is in fluid communication with the bottom hole 19.

As shown in FIG. 5*c*, bottom hole 19 is shaped with a larger opening on the bottom than on the top. In other words, the bottom hole 19 is somewhat funnel or conical shaped. One benefit of the funnel shape is that dirt and rocks are less likely to become trapped inside the hole. Another benefit of the funnel shape is that more air is directed to the bottom of the heel during the downward motion of the foot as discussed above.

Figure 6:
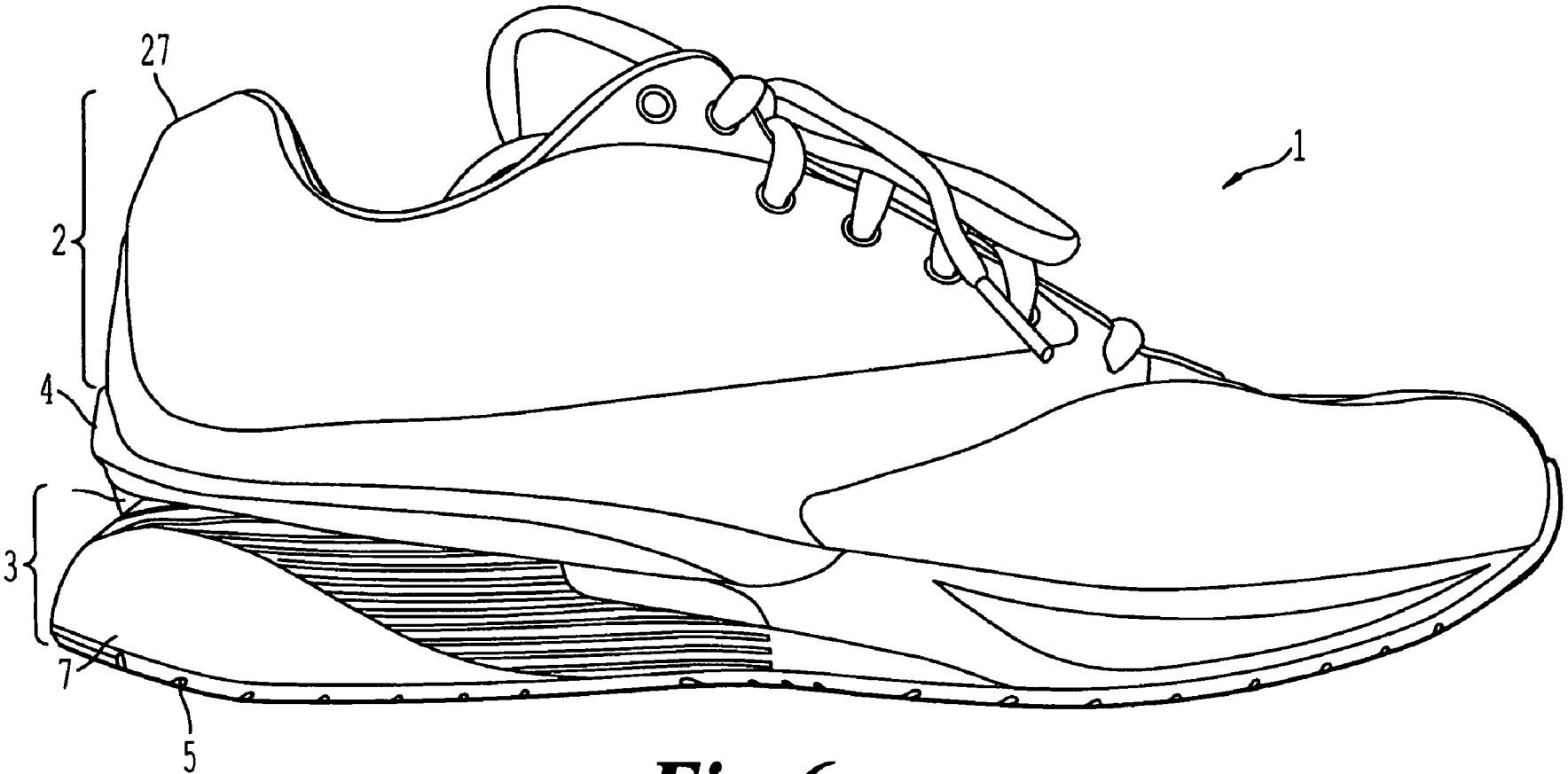
FIG. 6 shows the medial side of a sole assembly according to the first exemplary embodiment of the present invention.

FIG. 6 shows a medial side view of the first embodiment of the present invention. As shown in FIG. 6, the unitary midsole 7 has no hole on its medial side. Thus, the location of the lateral side hole 23 softens the lateral side of the sole assembly 3 relative to the medial side, thereby providing an effect similar to an arch support. The amount of support provided can be adjusted by changing the shape or thickness of the heel cradle 4, the hole frame 24, and the shape and size of the lateral side hole 23.

Figure 7A:
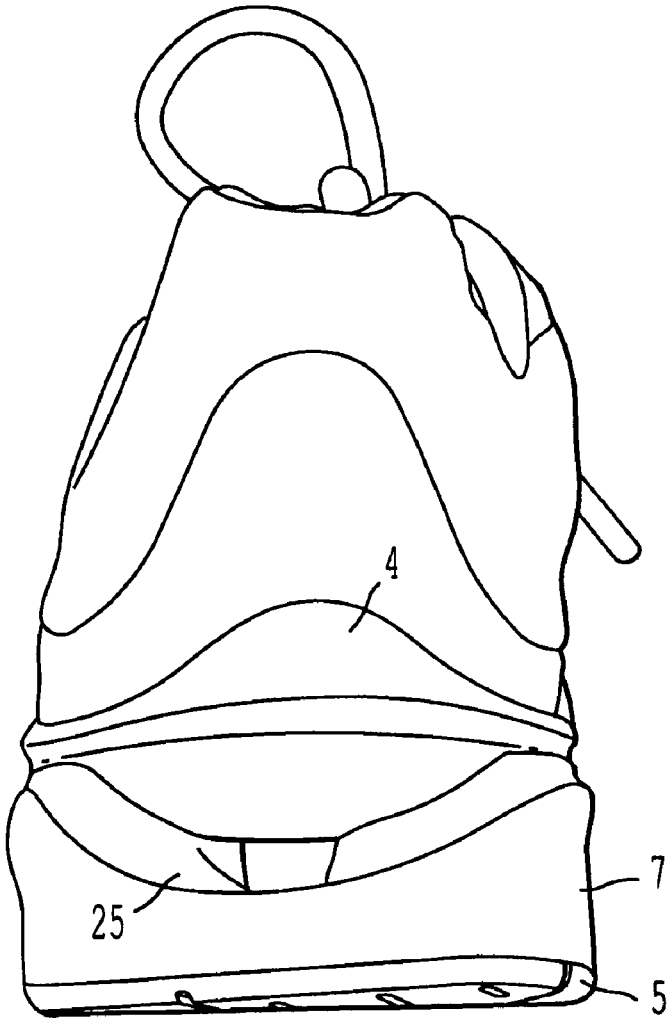
FIG. 7*a* shows a rear side of a shoe incorporating a sole assembly according to the first exemplary embodiment of the present invention.

FIG. 7*a* depicts a rear view of the first embodiment of the present invention. In FIG. 7*a*, the heel hole 25 is positioned approximately in the center of the heel region, but with a slight bias toward the lateral side of the shoe. Thus, the heel hole 25 provides a centering effect, while also facilitating proper pronation of the foot by softening the lateral side of the unitary midsole 7, even if no heel cradle is present. If the heel cradle is present, the centering effect of the heel cradle 4 is enhanced by the heel hole 25. For purposes of ventilation, the heel hole 25 is in fluid communication with the bottom hole 19 and the lateral hole 23.

Figure 7B:
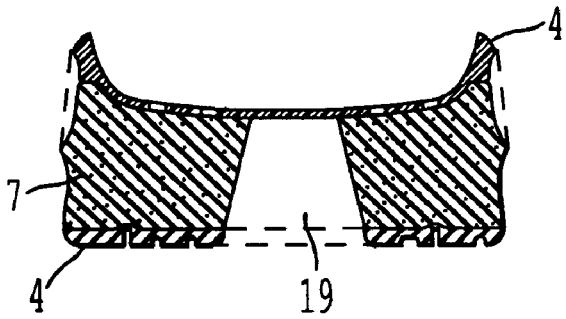
FIG. 7*b* shows a cross-section along line 7*b* of the sole assembly shown in FIGS. 4 and 7*a;*
Figure 8:
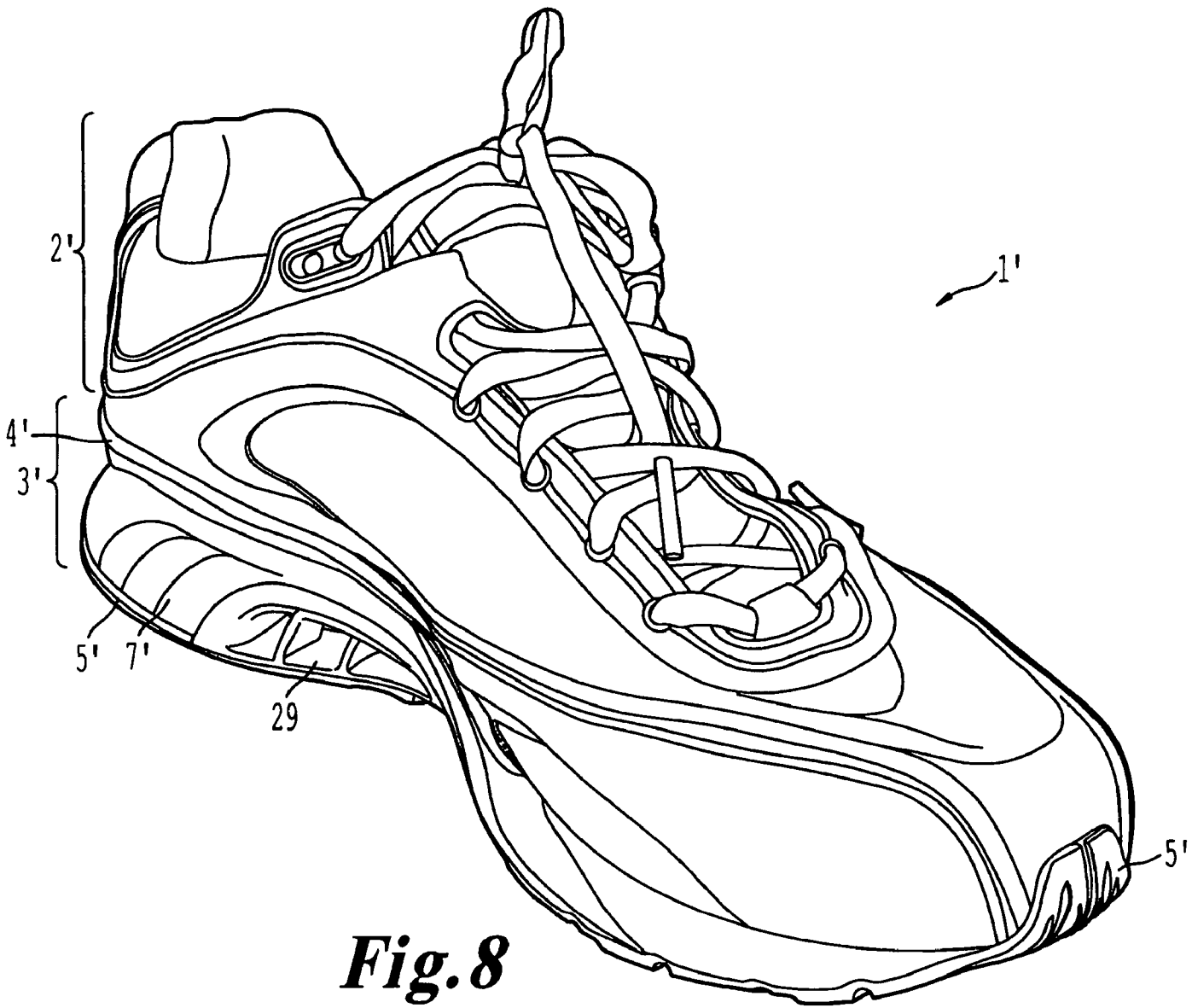
FIG. 8 is a perspective view of a left-foot shoe incorporating a sole assembly according to a second non-limiting embodiment of the present invention.
Figure 9:
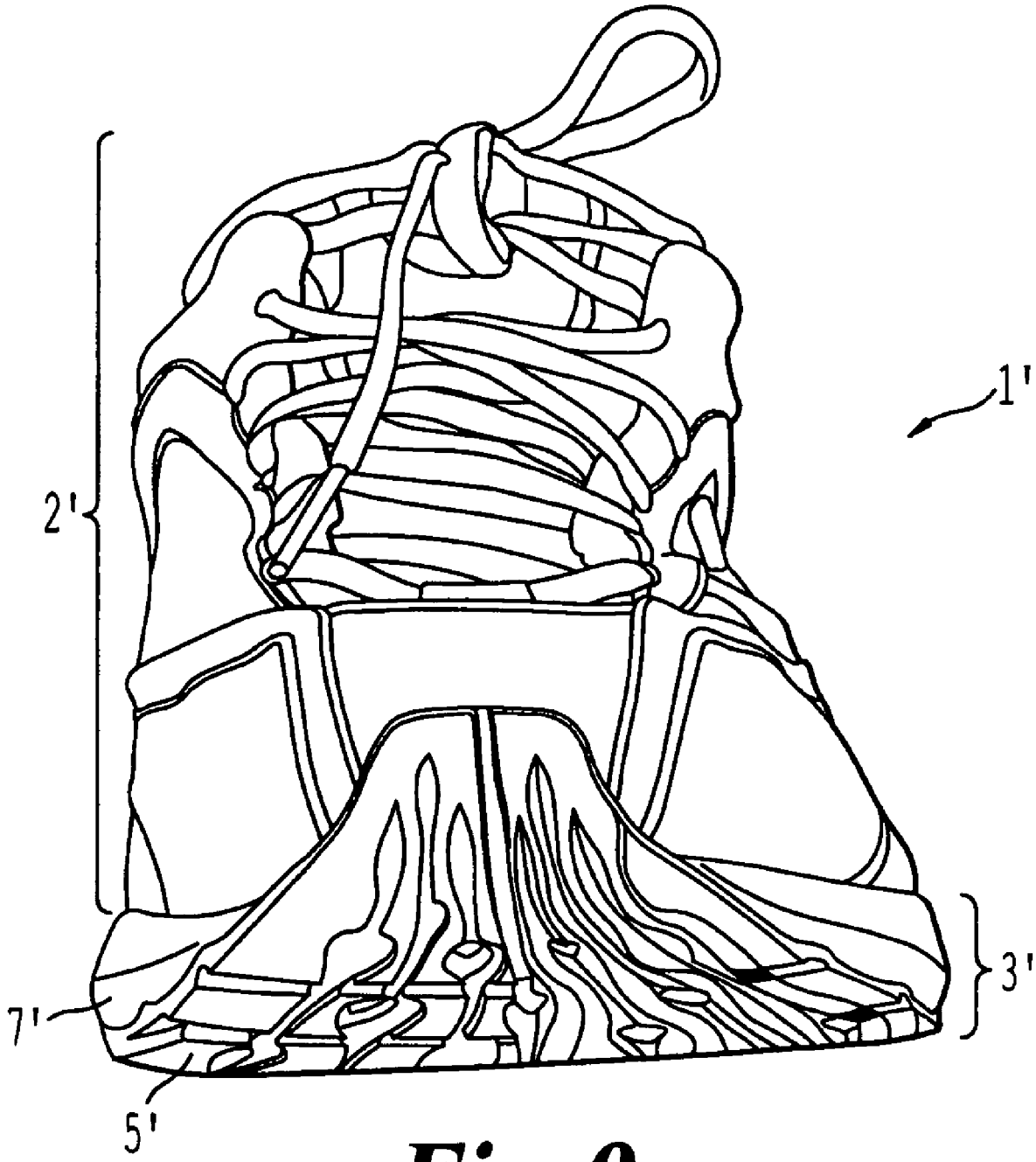
FIG. 9 is a front view of a shoe incorporating a sole assembly according to the second exemplary embodiment of the present invention.
Figure 10:
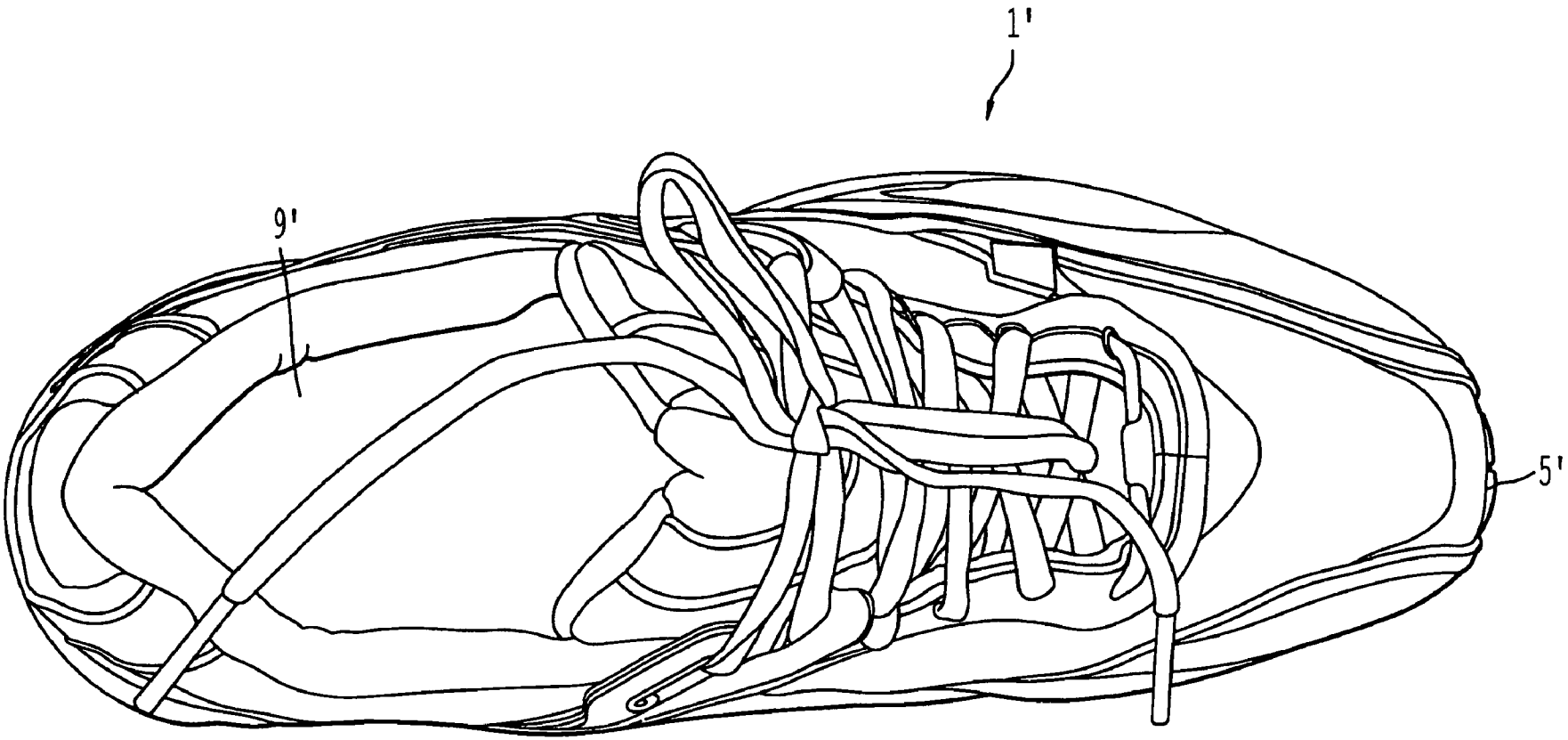
FIG. 10 is a top view of a shoe incorporating a sole assembly according to the second exemplary embodiment of the present invention.

FIG. 7*b* shows a cross-section of the sole assembly of FIG. 7*a* taken along line 7*b* shown in FIG. 4*a*. In this view, the conical shape of the bottom hole 19 and the cup-like shape of the heel cradle 4 are clearly shown. The bottom hole 19 and the heel hole 25 work in combination to control the stiffness profile of the unitary midsole 7.

FIGS. 8-14 show a second embodiment of the present invention. Corresponding structures from the first embodiment are shown with reference numbers including a prime symbol. For example, reference number 1 becomes 1'.

Figure 11:
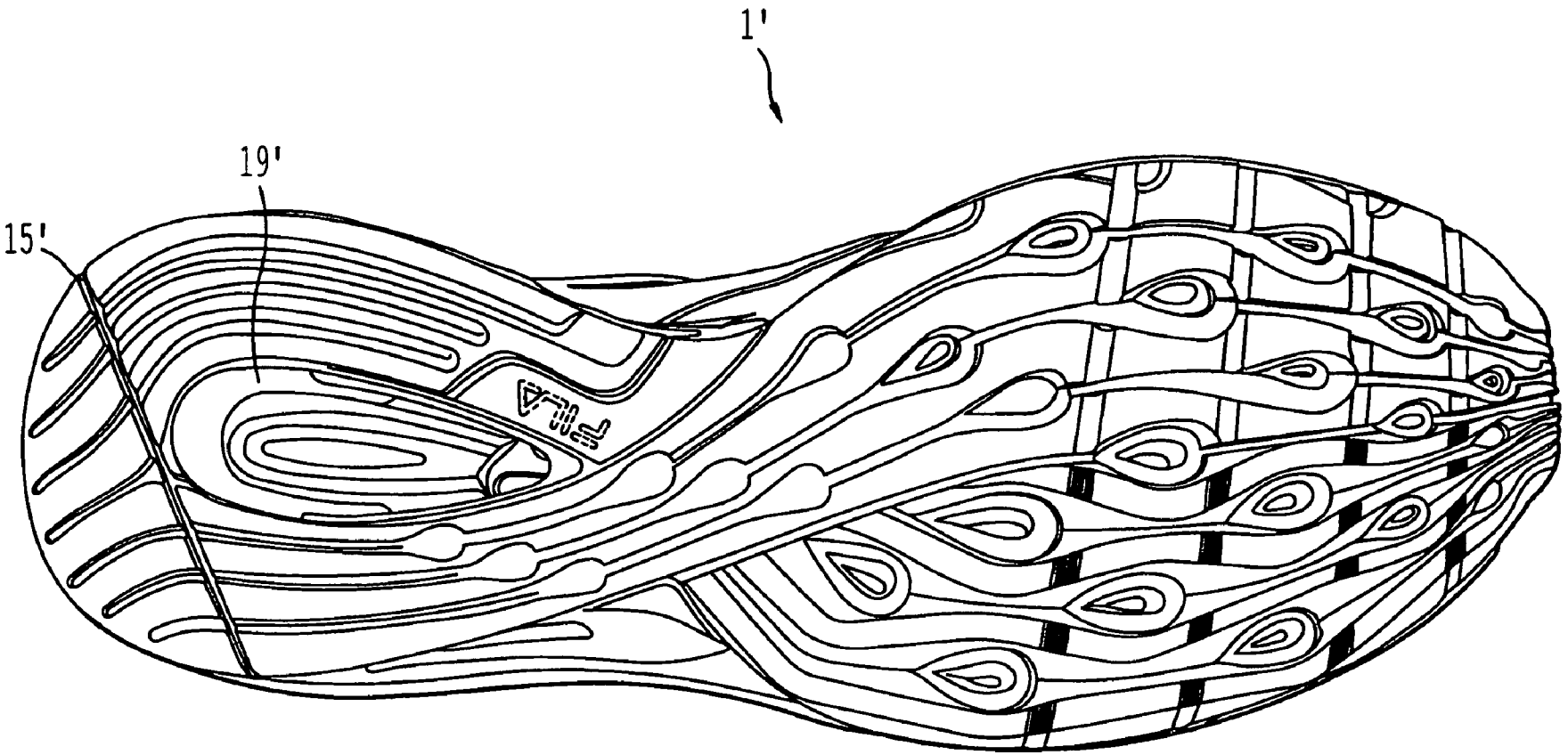
FIG. 11 is a bottom view of a shoe incorporating a sole assembly according to the second exemplary embodiment of the present invention.

As shown in FIGS. 8-15, the sole assembly 3' includes a heel cradle 4', outsole 5' and a unitary midsole 7'. As best seen in FIG. 11, the outsole 5' is substantially continuous, with only a small recessed area 50 on a medial side of the periphery. This recess corresponds to a medial side hole structure 29, which was not provided in the embodiment of FIG. 1. However, the relatively small size of the recess 50 does not substantially detract from the peripheral stability provided by the unitary midsole design. Other differences between the first and second embodiments will become apparent from the discussion below.

Figure 12:
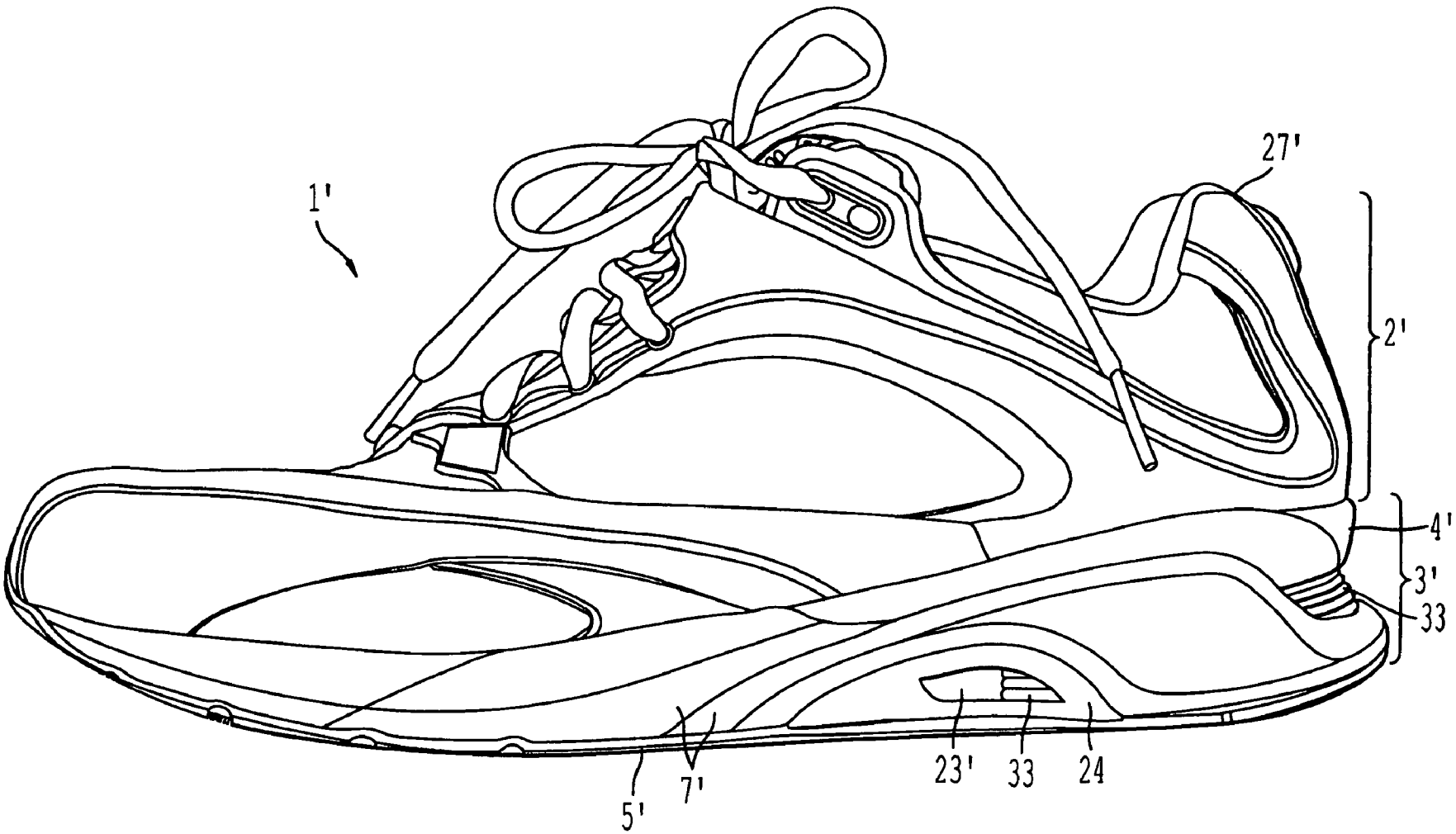
FIG. 12 shows the lateral side of a sole assembly according to the second exemplary embodiment of the present invention.

As best shown in the embodiment of FIG. 12, and in contrast to the lateral hole depicted in the embodiment of FIG. 5*a*, the lateral hole 23' is formed in the bottom of the unitary midsole 7' with the outsole 5' bordering the bottom boundary of the hole. Another difference between the two embodiments is that the lateral hole 23 depicted in FIG. 12 includes a hole frame 24. The hole frame 24 is typically formed of a different material than the rest of unitary midsole 7' and provides a rigid or semi-rigid structure to the lateral hole 23'. Thus, the heel cradle 4' and the hole frame 24 sandwich cushion material in the unitary midsole 7'. The hole frame 24 is streamlined to facilitate airflow into the lateral hole 23' and also to enhance aesthetic appeal. For example, to enhance visual impact, the hole frame 24 typically has a different color than the rest of the unitary midsole 7.

As further shown in FIG. 12, the heel cradle 4', attached to the outside of upper heel support 27', has a more uniform height than does the heel cradle of the first embodiment. Thus, increased support is provided to the sides of the foot, and the heel cradle 4' can provide a different centering effect of the foot within the shoe.

Figure 13:
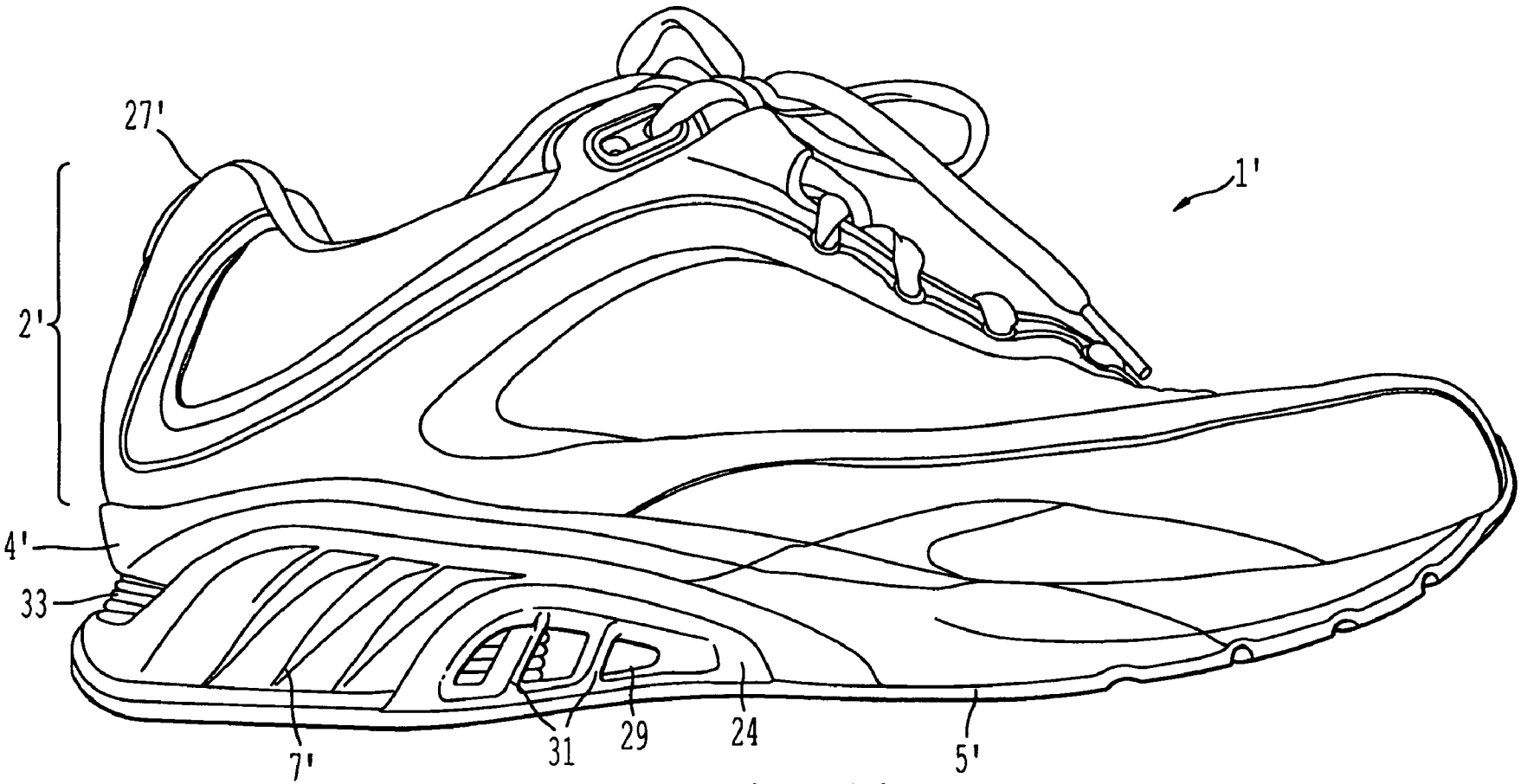
FIG. 13 shows the medial side of a sole assembly according to the second exemplary embodiment of the present invention.

FIG. 13 shows the medial side of the shoe 1' with a medial hole 29 similar to the lateral hole 23' shown in FIG. 12 except that the hole frame 24 surrounding medial hole 29 includes fins 31 to enhance the stiffness of medial hole 29. As discussed above, to achieve a proper amount of pronation, the lateral hole is included to soften the lateral side of the unitary midsole. However, in some embodiments, to enhance air flow and/or adjust the stiffness of the sole assembly, both medial and lateral holes are included in the unitary midsole. Thus, various methods of stiffening the area around the medial hole 29 are used. For example, the size or shape of the medial hole 29 can be changed to make the unitary midsole 7' in the vicinity of the medial hole 29 stiffer. In the embodiment shown in FIG. 13, fins 31 strengthen the structure around the medial hole. In this case, the fins 31 are thin, blade-like structures which allow air to pass freely into the medial hole 29 while still providing structural rigidity. Aesthetic touches such as slanting the tops of the fins forward are also sometimes included.

Figure 14:
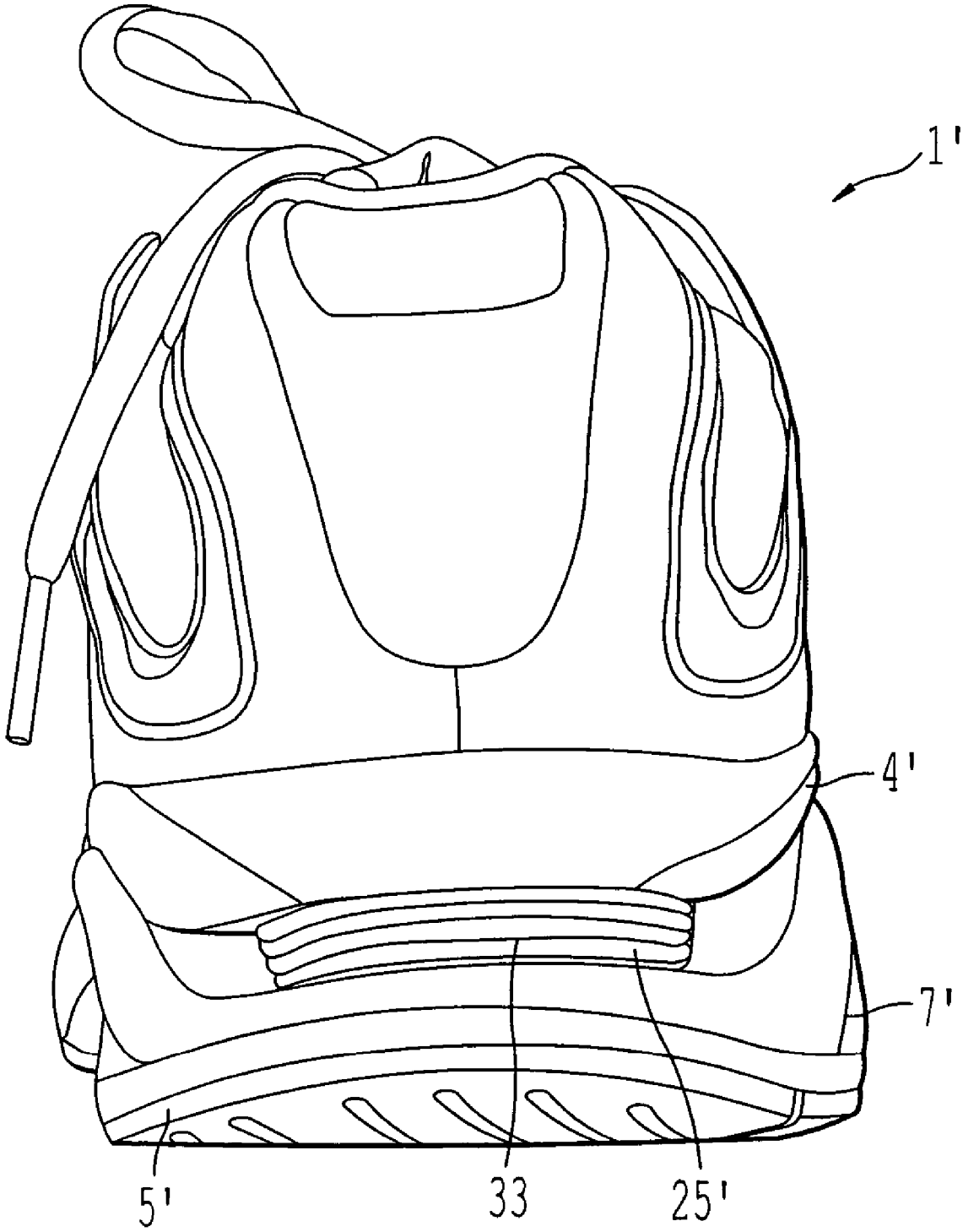
FIG. 14 shows a rear side of a shoe incorporating a sole assembly according to the second exemplary embodiment of the present invention.
Figure 15:
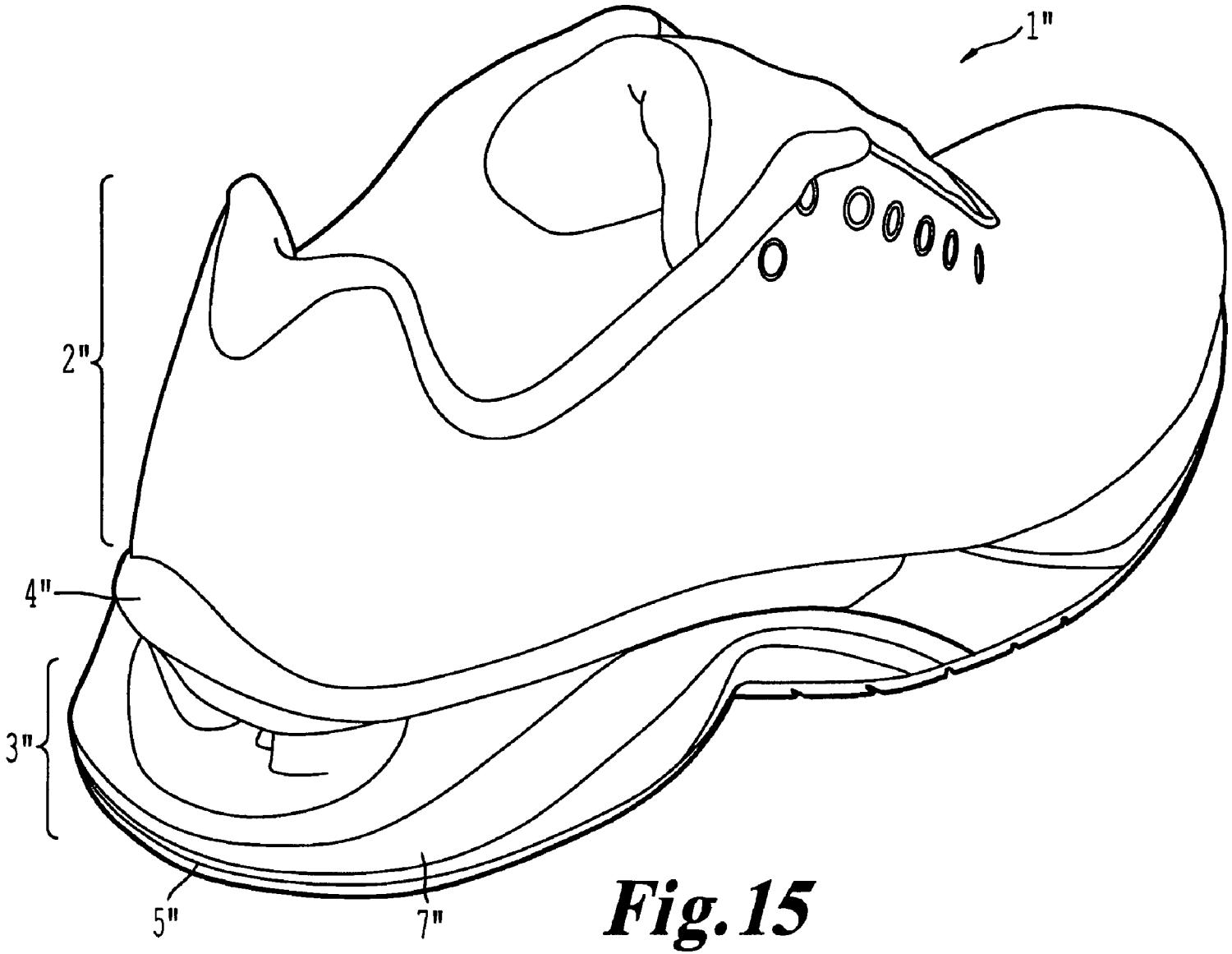
FIG. 15 is a perspective view of a right-foot shoe incorporating a sole assembly according to a third non-limiting embodiment of the present invention.
Figure 16:
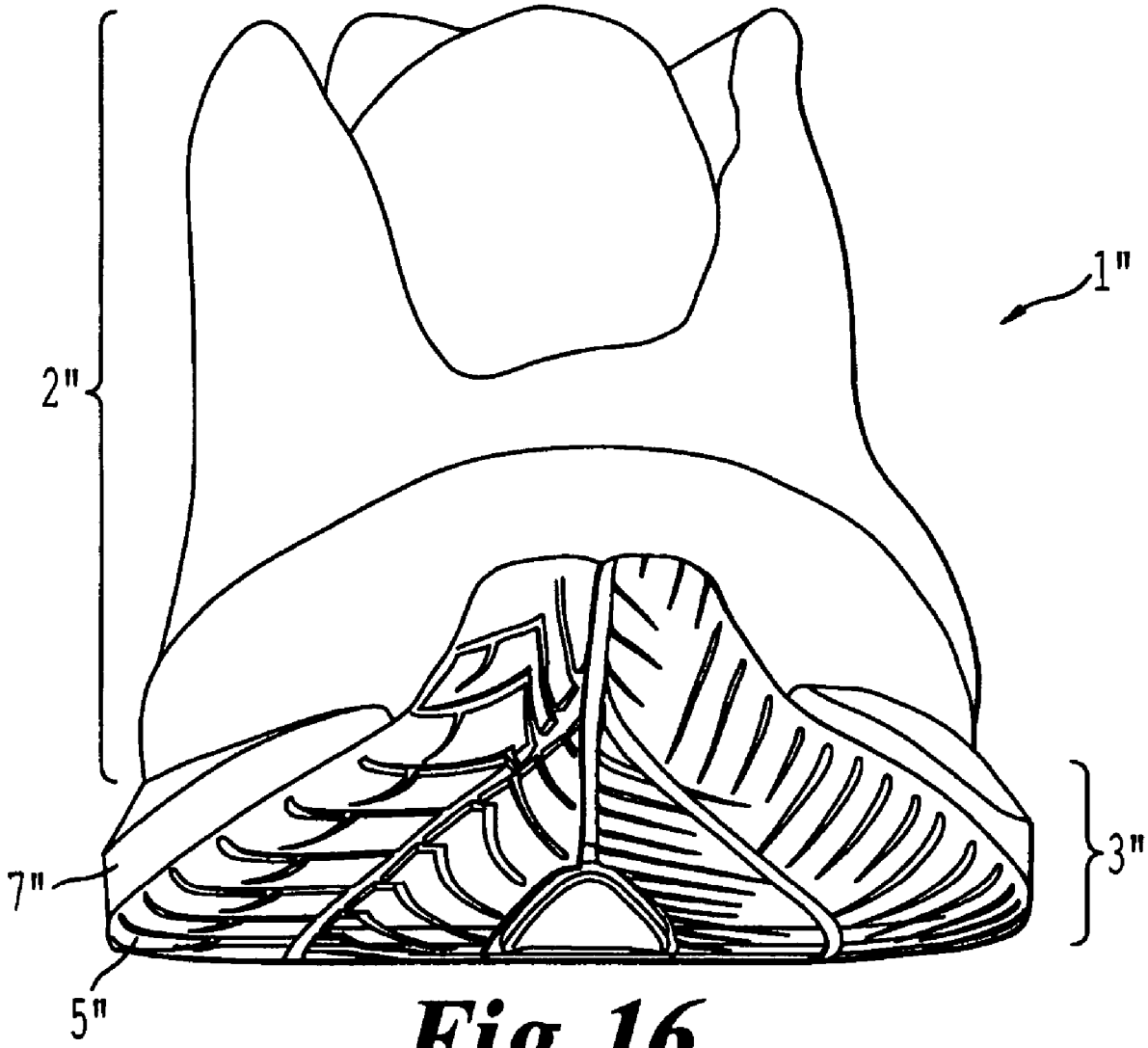
FIG. 16 is a front view of a shoe incorporating a sole assembly according to the third exemplary embodiment of the present invention.
Figure 17:
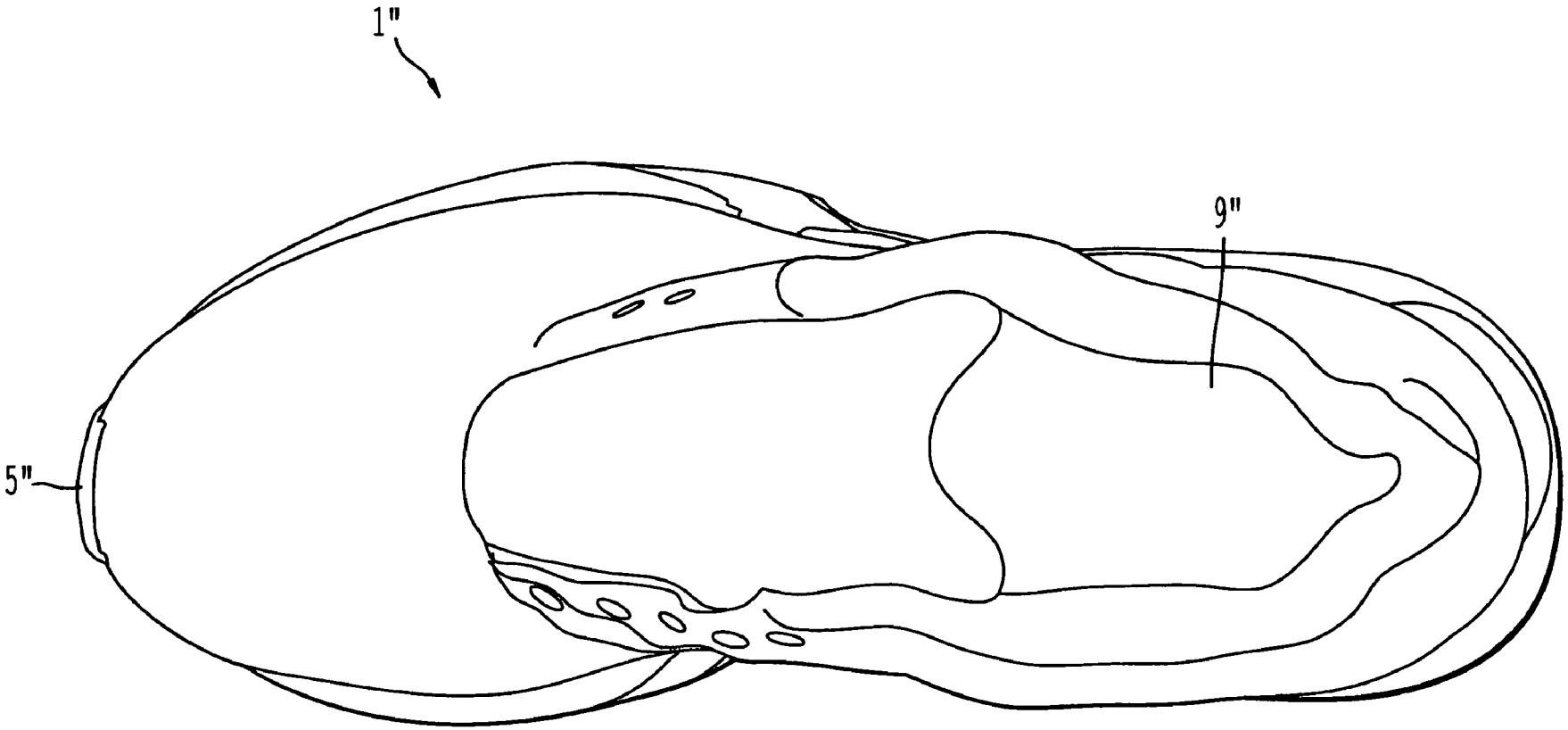
FIG. 17 is a top view of a shoe incorporating a sole assembly according to the third exemplary embodiment of the present invention.
Figure 18:
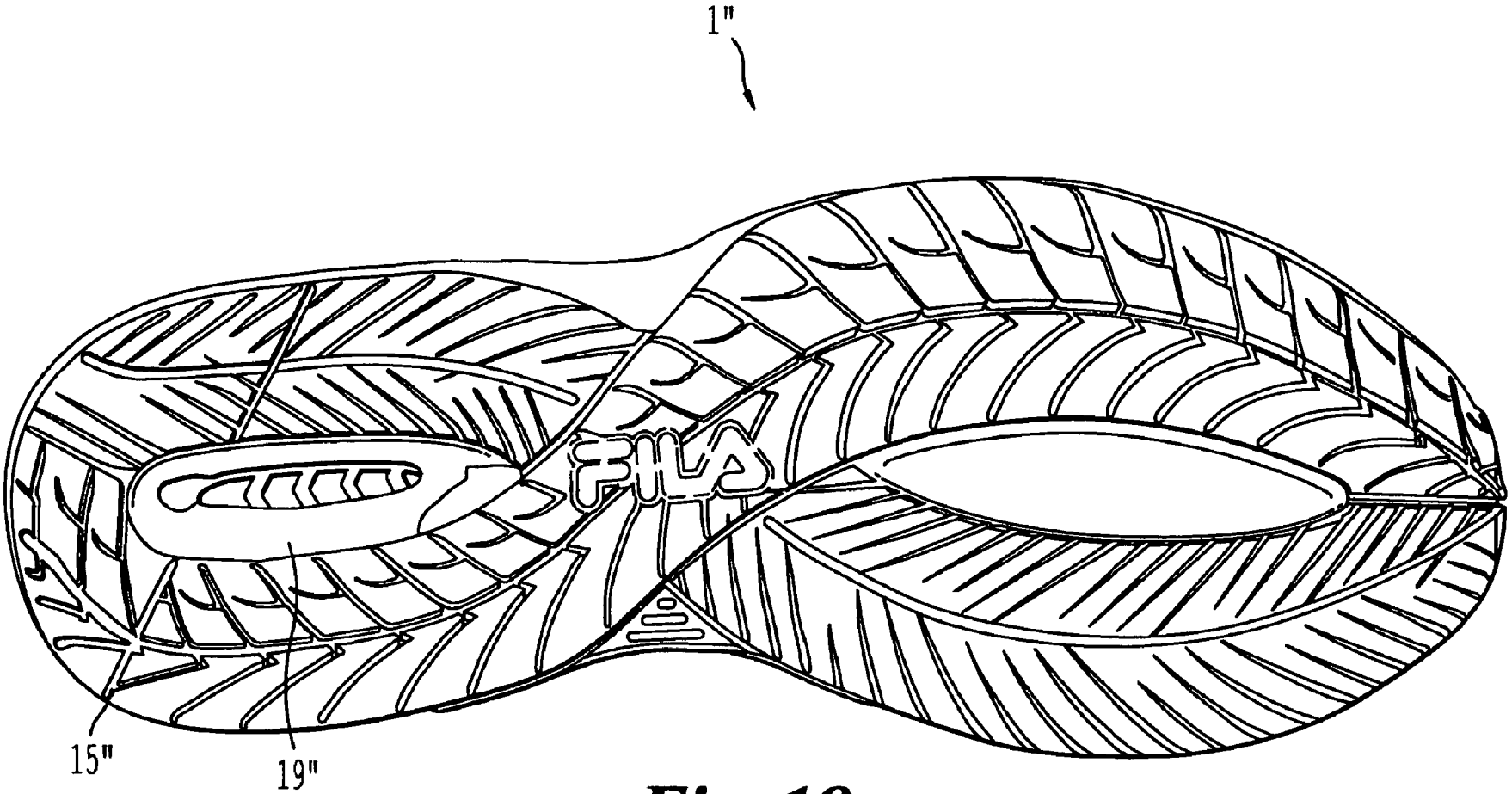
FIG. 18 is a bottom view of a shoe incorporating a sole assembly according to the third exemplary embodiment of the present invention.

FIG. 14 shows a rear view of the second embodiment of the present invention. In this view, the heel hole 25' is filled with a heel cushion 33. The heel cushion 33 is typically a softer material than the unitary midsole 7'. Therefore, the heel cushion 33 enhances the centering effect of the heel cradle 4' in a similar way that the heel hole of the first embodiment does. For aesthetic purposes, the heel cushion 33 may be textured and have a different color than the unitary midsole 7'.

FIGS. 15-21 depict a third embodiment of the present invention. Note that for this embodiment, a shoe for the right-side foot is depicted. Features corresponding to the first embodiment, shown in FIGS. 1-7, will be shown with reference numbers having a double prime mark. For example, reference numbers 1 and 1' become 1".

Figure 19:
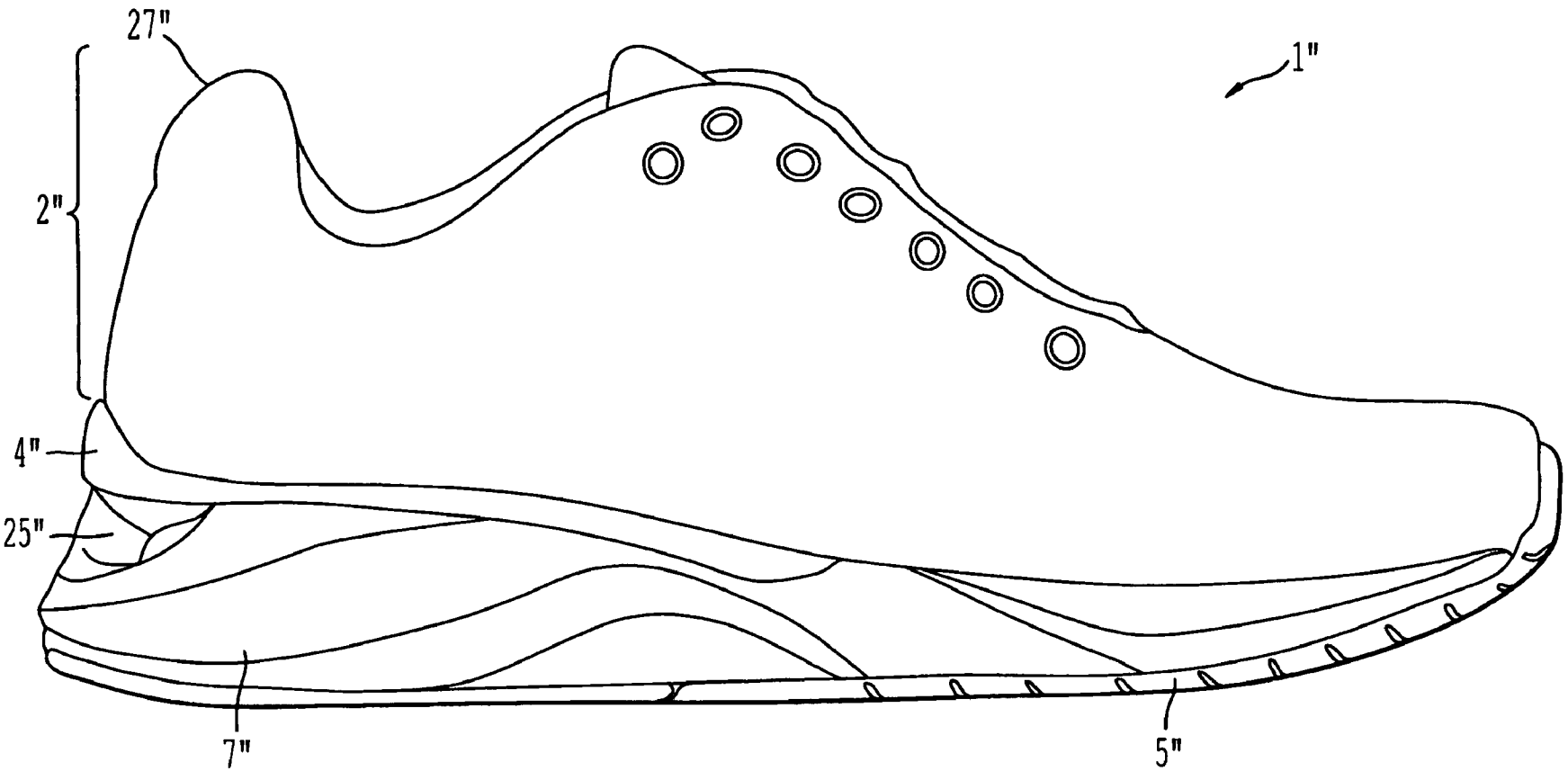
FIG. 19 shows the lateral side of a sole assembly according to the third exemplary embodiment of the present invention.

Unlike the first two embodiments, the unitary midsole 7" of the third embodiment does not have a lateral hole. The lateral side of the shoe 1" is best shown in FIG. 19. The lateral hole may be omitted when the wearer has a tendency to underpronate. Thus, without the lateral hole, the lateral side of the unitary midsole 7" is stiffer and the outside edge of the foot will compress the sole assembly 3" to a lesser extent.

Figure 20:
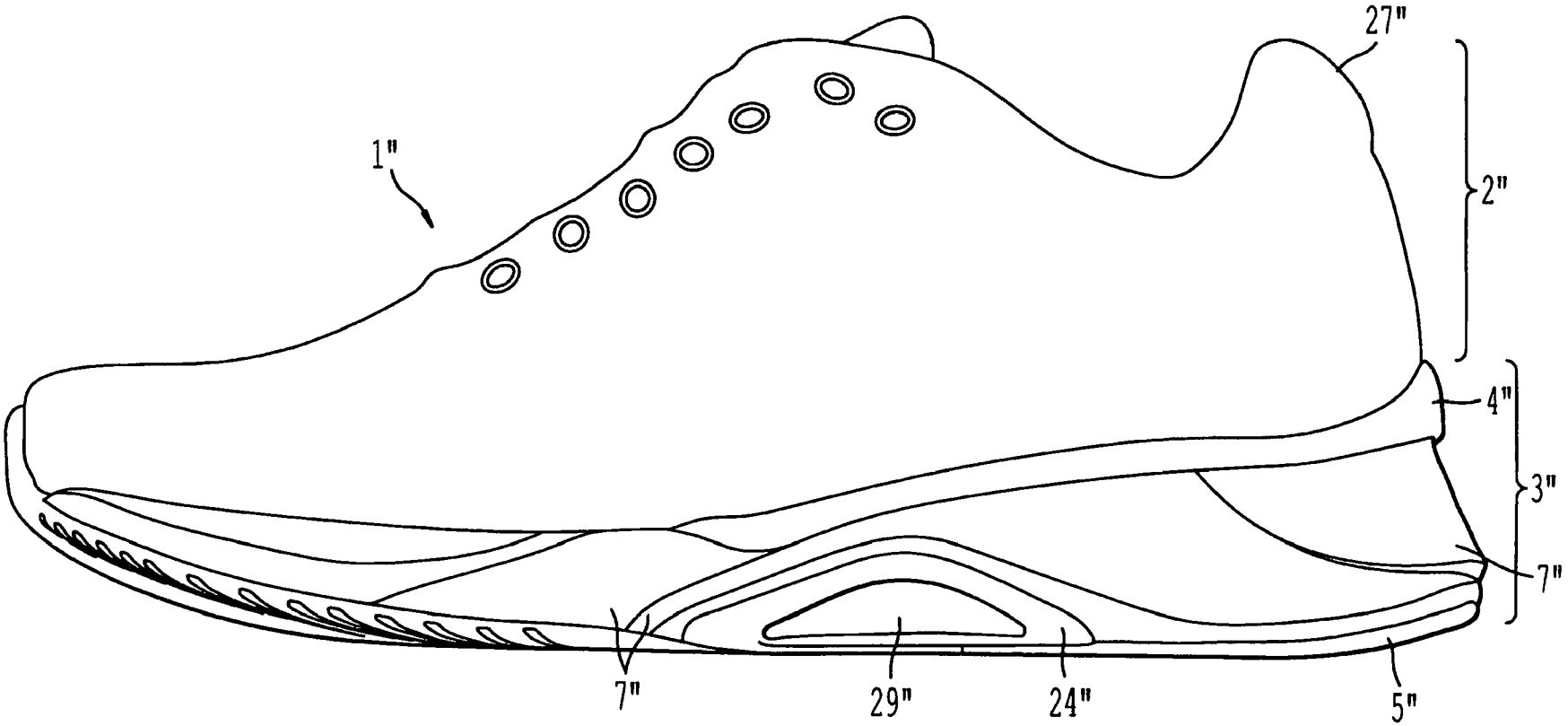
FIG. 20 shows the medial side of a sole assembly according to the third exemplary embodiment of the present invention.

FIG. 20 shows the sole assembly 3" with medial hole 29" and hole frame 24, but no fins 31. Thus, fins 31 are optional and are included when additional stiffness is required, or to enhance aesthetic appearance. Like the lateral holes described above, the medial holes are in fluid communication with the bottom hole 19. The inclusion of the medial hole 29" enhances the effect of the exclusion of the lateral hole regarding pronation of the foot. In other words, a sole assembly 3" with a medial hole 29", but no lateral hole will typically have a stronger tendency to pronate the foot of the wearer.

Figure 21:
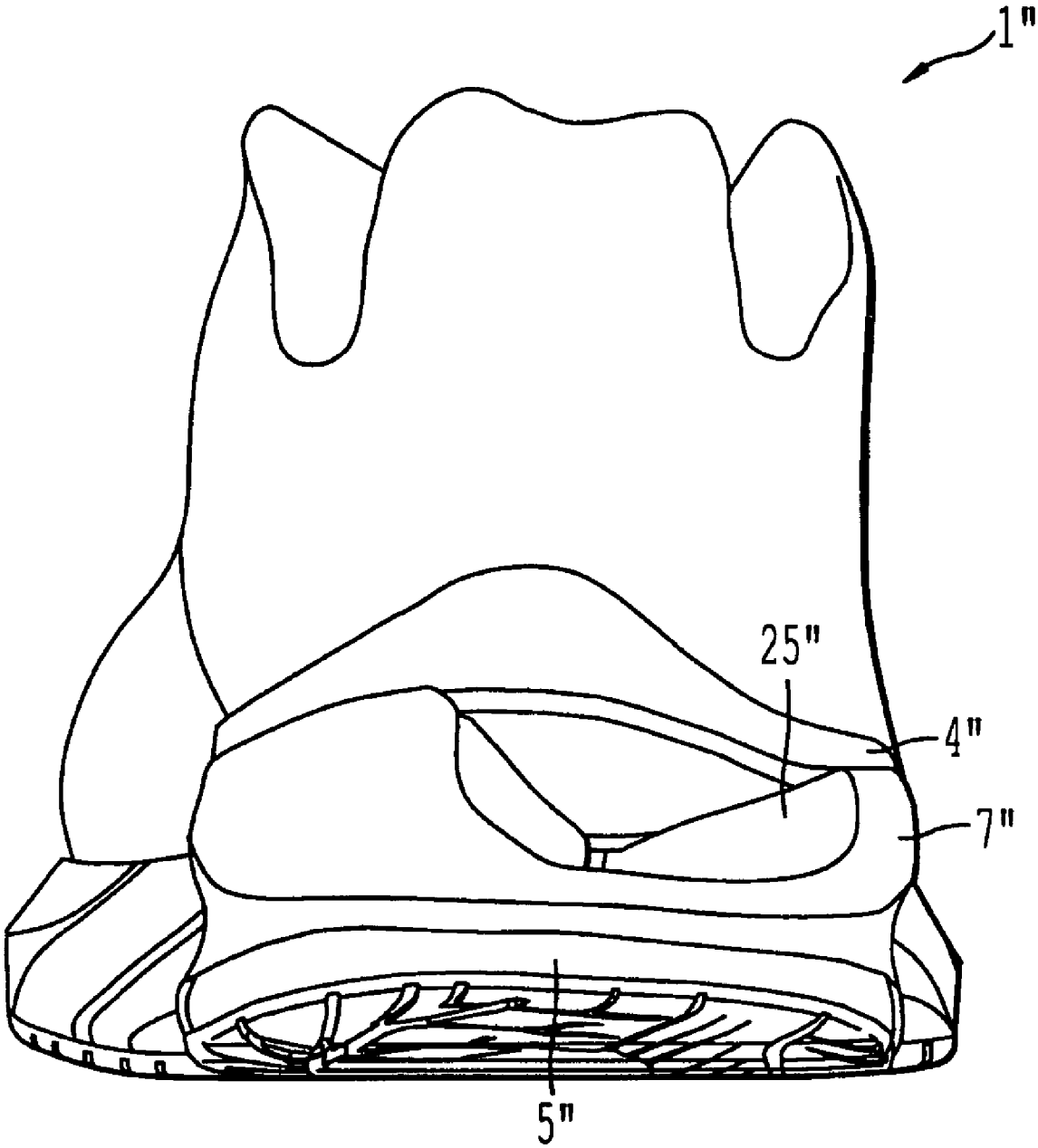
FIG. 21 shows a rear side of a shoe incorporating a sole assembly according to the third exemplary embodiment of the present invention.

FIG. 21 shows a rear view of the third exemplary embodiment of the present invention. In this embodiment, the heel hole 25" is greatly biased toward one side of the sole assembly. As shown in FIG. 21, the bias is toward the medial side of the shoe. However, in other embodiments, the bias is toward the lateral side of the shoe. By biasing the heel hole toward one side or the other, the tendency for pronation of a given sole assembly is controlled. For example, for feet with weak arches, the sole assembly 3" may be designed with a heel hole 25" strongly biased toward the lateral side of the unitary midsole 7. To compliment the effect of the heel hole 25", a lateral hole 23 may be included. Conversely, for feet that tend to under-pronate, a heel hole 25" shifted to the medial side would be preferable. Again, to enhance the effect of the heel hole 25, a medial hole could be included as discussed above.

Aside from the specific embodiments described above, any combination or permutation of medial holes, lateral holes, heel holes and bottom holes is possible. For example, a sole assembly 3 could include a medial hole 29, a lateral hole 23, a heel hole 25 (biased in either the lateral or medial directions), and a bottom hole 19. Moreover, either or both of the medial and lateral holes could include fins 31. In addition, many of the items depicted in the drawings include purely aesthetic features, and, therefore, may be reshaped without altering their functionality. Still further, it is to be understood that features of specific embodiments may be used with other embodiments.

Clearly, numerous modifications and variations of the present invention are possible in light of the above teachings. It is therefore to be understood that within the scope of the appended claims, the invention may be practiced otherwise than as specifically described herein. For example, one advantage of the unitary midsole structure is that it provides an opportunity to develop structural enhancements to the sole assembly that extend into the midfoot region. U.S. patent application "Footwear Sole Assembly Having Spring Mechanism", filed Nov. 10, 2005 and having Ser. No. 11/270,526 discloses a sole assembly spring mechanism implemented into a unitary midsole. The entire content of this application is incorporated herein by reference.

The invention claimed is:

1. A sole assembly comprising:

a midsole made of resilient cushion material and having an upper support surface configured to support a plantar region of a human foot, a lower surface and a sidewall connecting the upper and lower surfaces;

an outsole provided on the lower surface and configured to provide traction with a ground surface;

at least one sidewall hole provided in the sidewall, wherein the at least one sidewall hole is provided at a predetermined position in the sidewall in order to accommodate a characteristic of the foot;

a bottom hole extending through the outsole through the sole assembly to said upper surface, said bottom hole being in fluid communication with the at least one sidewall hole and an area external to the outsole;

a heel cushion disposed on a heel region of the midsole on a side of the midsole opposite the outsole and having a softness greater than a softness of the midsole and extending no farther forward than the at least one sidewall hole; and a semi-rigid heel cradle coupled to the upper support surface and configured to cradle and support a heel region of the foot from beneath the foot and to support a plurality of sides of the foot when the foot is rested in a heel area of the sole assembly, wherein the heel cradle extends from the heel portion to a midfoot portion of the sole assembly, and overlaps said at least one sidewall hole, wherein the cradle has a stiffness different than a stiffness of the midsole and extends from a rear of the midsole to a point no more than half-way to a front of the midsole, and wherein the heel cushion is sandwiched between the heel cradle and the midsole.

2. The sole assembly of claim 1, wherein the at least one sidewall hole comprises an offset hole disposed at a position on the sidewall offset from a heel center of the sole assembly in a direction parallel to a surface of the outsole.

3. The sole assembly of claim 2, wherein the offset hole comprises a sidewall hole offset to a lateral side from the heel center in order to reduce structural support on the lateral side of the sole assembly to compensate for over pronation.

4. The sole assembly of claim 3, wherein the offset hole comprises a lateral hole positioned on a lateral sidewall of the sole assembly.

5. The sole assembly of claim 4, further comprising a screen provided in the bottom hole to obstruct the hole at an opening to the upper surface of the midsole.

6. The sole assembly of claim 5, wherein the screen comprises pellet-sized holes.

7. The sole assembly of claim 2, wherein the offset hole comprises a medial sidewall hole offset to a medial side from the heel center in order to reduce structural support on the medial side of the sole assembly to compensate for under pronation.

8. The sole assembly of claim 7, wherein the offset hole comprises a medial hole positioned on a medial sidewall of the sole assembly.

9. The sole assembly of claim 1, wherein said at least one sidewall hole comprises a plurality of sidewall holes, at least one of which is provided at a predetermined position in the sidewall in order to accommodate a characteristic of the foot.

10. The sole assembly of claim 1, wherein the midsole comprises a unitary midsole with said lower surface being a substantially contiguous lower surface extending from a heel portion of the sole assembly to a toe portion of the sole assembly.

11. The sole assembly of claim 1, wherein the bottom hole extends from the outsole through the sole assembly and the heel cradle to said upper surface.

12. A sole assembly comprising:

a midsole made of resilient foam material and having an upper support surface configured to support a plantar region of a human foot, a lower surface and sidewall connecting the upper and lower surfaces;

an outsole provided on the lower surface and configured to provide traction with a ground surface;

means for biasing the foot in a lateral or medial direction to accommodate a characteristic of the foot;

a bottom hole extending from the outsole through the sole assembly to said upper surface, said bottom hole being in fluid communication with at least one sidewall hole and an area external to the outsole;

a heel cushion disposed on a heel region of the midsole on a side of the midsole opposite the outsole and having a softness greater than a softness of the midsole and extending no farther forward than the at least one sidewall hole; and a semi-rigid heel cradle coupled to the upper support surface and configured to cradle and support a heel region of the foot from beneath the foot and to support a plurality of sides of the foot when the foot is rested in a heel area of the sole assembly, wherein the heel cradle extends from the heel portion to a midfoot portion of the sole assembly, and overlaps said at least one sidewall hole, wherein the cradle has a stiffness different than a stiffness of the midsole and extends from a rear of the midsole to a point no more than half-way to a front of the midsole, and wherein the heel cushion is sandwiched between the heel cradle and the midsole.

13. The sole assembly of claim 1, wherein the heel cradle is stiffer than the midsole.

* * * * *